US007063360B2

(12) United States Patent
Fukunaga et al.

(10) Patent No.: US 7,063,360 B2
(45) Date of Patent: Jun. 20, 2006

(54) DOOR LOCK DEVICE

(75) Inventors: Katsutoshi Fukunaga, Chiryu (JP); Makoto Suzumura, Chita (JP); Shigehiro Oya, Toyoake (JP); Akira Muramatsu, Chiryu (JP); Yukinobu Kunimatsu, Aichi (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 70 days.

(21) Appl. No.: 10/777,152

(22) Filed: Feb. 13, 2004

(65) Prior Publication Data

US 2005/0023840 A1 Feb. 3, 2005

(30) Foreign Application Priority Data

Feb. 17, 2003 (JP) ..... 2003-038438

(51) Int. Cl.
*E05C 3/06* (2006.01)

(52) U.S. Cl. ..... 292/216; 292/337

(58) Field of Classification Search ..... 292/216, 292/201, 337
See application file for complete search history.

(56) References Cited

U.S. PATENT DOCUMENTS 6,338,508 B1 * 1/2002 Kleefeldt ..... 292/201
6,511,106 B1 * 1/2003 Perkins et al. ..... 292/216
6,511,107 B1 * 1/2003 Barczynski et al. ..... 292/216
2001/0038211 A1 11/2001 Hayakawa et al.
2002/0000725 A1 * 1/2002 Ostrowski et al. ..... 292/199

FOREIGN PATENT DOCUMENTS

EP 0 808 979 A2 11/1997
JP 2002081237 3/2002
WO 00/00710 1/2000
WO 01/20112 A1 3/2001

* cited by examiner

*Primary Examiner*—Gary Estremsky
(74) *Attorney, Agent, or Firm*—Buchanan Ingersoll PC

(57) ABSTRACT

A door lock device includes a latch mechanism selectively engaging with a striker, an open unit operating at a plane surface perpendicular to one direction for transmitting an opening operational force from a vehicle inside and from a vehicle outside to operate the latch mechanism from an engaged state with the striker to the disengaged state from the striker, and a lock unit operating at a plane surface perpendicular to said one direction for transmitting an operational force to the open unit for operating the open unit to be an unlocked state for transmitting the opening operational force to the latch mechanism and a locked state not for transmitting the opening operational force to the latch mechanism.

11 Claims, 28 Drawing Sheets

DOOR LOCK DEVICE

This application is based on and claims priority under 35 U.S.C. § 119 with respect to Japanese Patent Application No. 2003-038438 filed on Feb. 17, 2003, the entire contents of which are incorporated herein by reference.

FIELD OF THE INVENTION

The present invention relates to a door lock device.

BACKGROUND OF THE INVENTION

A known door lock device described in Japanese Patent Laid-Open Publication No. 2002-081237 includes a lever attaching surface including a base piece and a side piece formed by bending a side end of the base piece perpendicularly. The known door lock device described in Japanese Patent Laid-Open Publication No. 2002-081237 includes an open lever unitarily rotatable with an engagement member, a connect lever moving to two positions, and an outside lever and an inside lever connected to a release operation means provided at inside and outside of the door, which are provided at the lever attaching surface. The outside lever is secured to the lever attaching surface with an axis arranged in the fore-aft direction. The connection portion is connected to an outside handle serving as the release operation means provided at the outside of the vehicle door via a wire. The connector lever is secured to the lever attaching surface with an axis arranged in the fore-aft direction so that the connector lever is rotatable to be the two positions including a locked position and an unlocked position. In the meantime, the inside lever is secured to the side piece with an axis in the direction of vehicle inside and outside, that is, in the right-left direction. The connection portion is connected to an inside handle serving as the release operation means provided at an interior side of the door via a wire.

With the construction of the known door lock device described in Japanese Patent Laid-Open Publication No. 2002-081237, the outside lever and the connector lever operate at a plane surface arranged approximately perpendicular to the axis in the fore-aft direction. Further, the inside lever operates at a plane surface arranged to be approximately perpendicular to the axis in the right-left direction. In other words, because plural levers operate at different plane surfaces in the different directions, there has been the limitation for reducing the size in each direction of the door lock device (i.e., an extending direction of the plane surface approximately perpendicular to the axis in the fore-aft direction and an extending direction of the plane surface approximately perpendicularly to the axis in the right-left direction) in order to ensure the operation range of the levers.

A need thus exists for a door lock device with smaller size.

SUMMARY OF THE INVENTION

In light of the foregoing, the present invention provides a door lock device, which includes a latch mechanism for being selectively engaging with a striker, an open unit operating at a plane surface perpendicular to one direction for transmitting an opening operational force from a vehicle inside and from a vehicle outside to operate the latch mechanism from an engaged state with the striker to the disengaged state from the striker, and a lock unit operating at a plane surface perpendicular to said one direction for transmitting an operational force to the open unit for operating the open unit to be an unlocked state for transmitting the opening operational force to the latch mechanism and a locked state not for transmitting the opening operational force to the latch mechanism.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
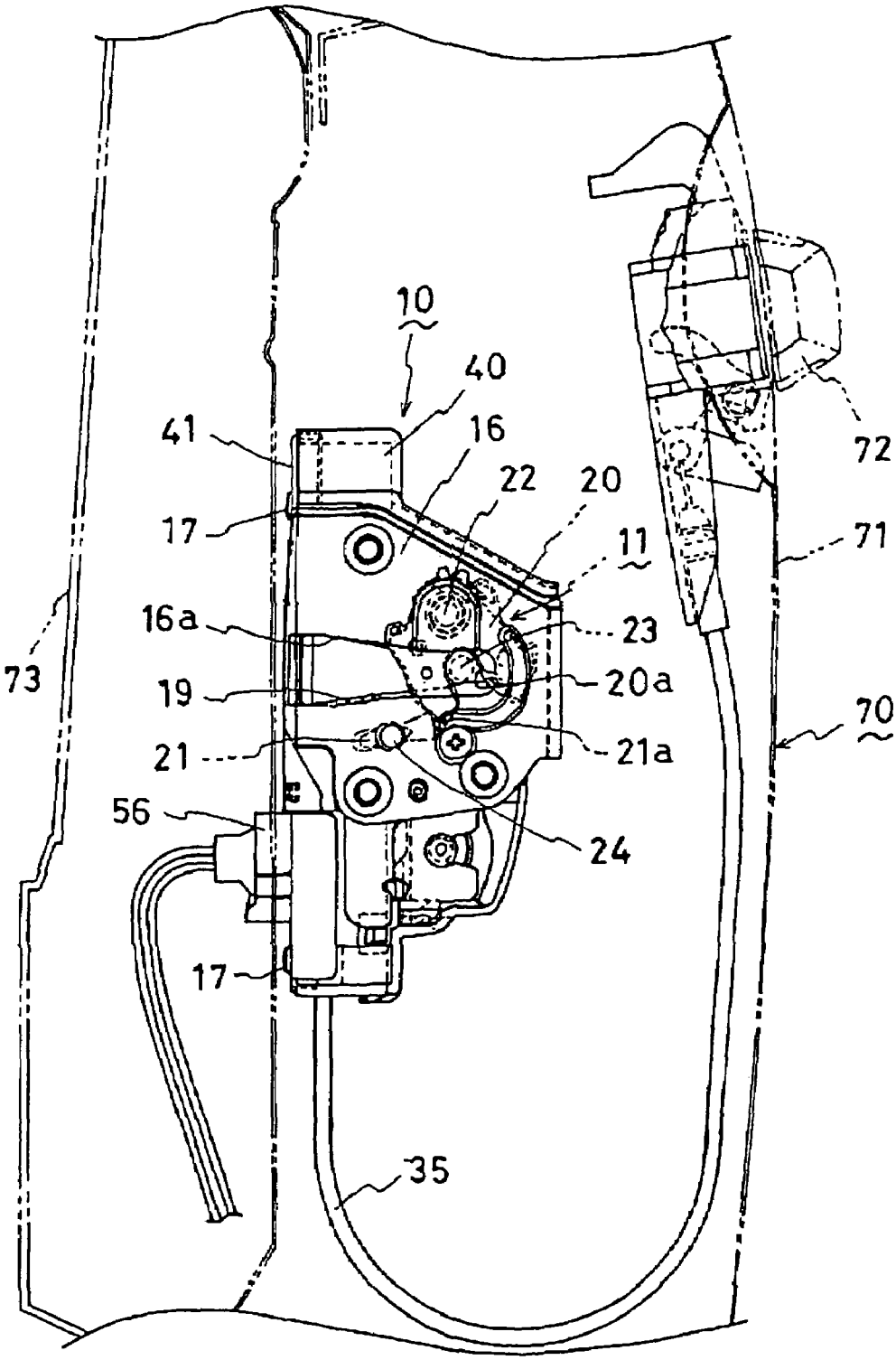
FIG. 1 is a view showing a latch mechanism of a door lock device according to a first embodiment of the present invention.

Embodiments of the present invention will be explained with reference to the illustrations of the drawing figures as follows.

As shown in FIG. 1, a door lock device 10 according to a first embodiment is provided at a door 70 of a vehicle. With the first embodiment, the door 70 corresponds to a side door provided at a right side of the vehicle viewing a front direction. FIG. 1 shows the vehicle viewed from the rear side. Thus, the right direction of FIG. 1 shows the exterior of the vehicle and the left direction of FIG. 1 shows the interior of the vehicle. The door provided with the door lock device of the first embodiment is not limited to the side door. The door lock device of the present invention may be provided at a back door assembled at the rear of the vehicle, or the like.

Figure 3:
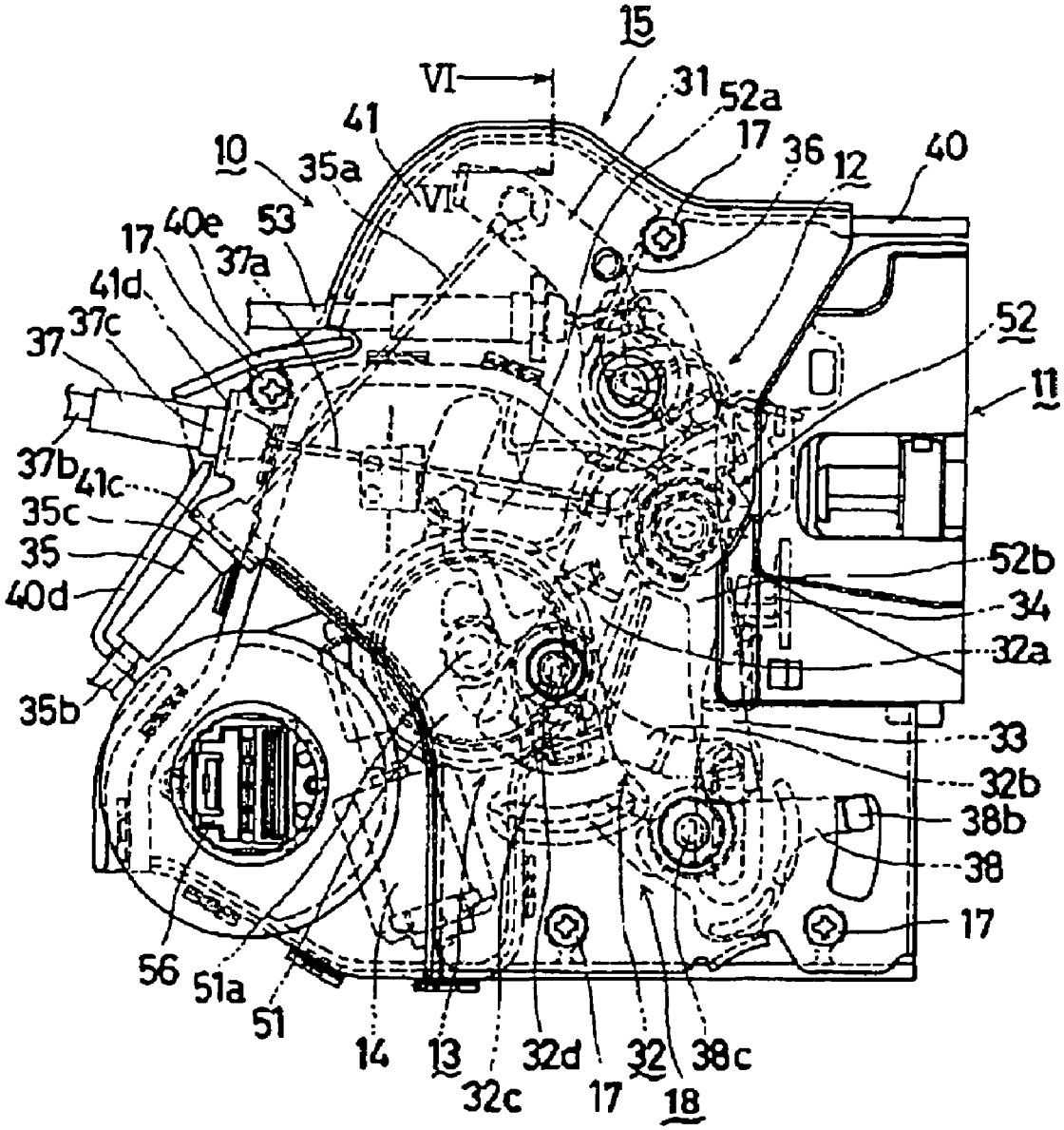
FIG. 3 is a partial view showing a lock mechanism and a motor according to the first embodiment of the present invention.

As shown in FIG. 3, the door lock device 10 includes a latch mechanism 11 serving as a latch mechanism, a lock mechanism 18 including an open unit 12 and a lock unit 13 serving as a lock unit, and a motor 14. The latch mechanism 11, the lock mechanism 18, and the motor 14 are unitarily accommodated in a housing 15.

As shown in FIG. 1, the latch mechanism 11 is provided between a base 16 including a plane surface extended in an inside-outside direction of the vehicle corresponding to a thickness direction of the door 70 (i.e., right-left direction of FIG. 1) and a plane surface extended in a upward-downward direction of the vehicle (i.e., upward-downward direction of FIG. 1) and a resin base 19 including a plane surface in parallel with the base 16 and positioned at vertically deeper side than the base 16 shown in FIG. 1. The latch mechanism 11 includes a latch 20 and a pawl 21. The latch 20 is rotatably supported by a latch axis 22 supported by the resin base 19 and extended in the vertical direction shown in FIG. 1 corresponding to the width direction of the door 70. The latch 20 includes an engagement groove 20*a*. The engagement groove 20*a* engagingly maintains a striker 23 serving as a striker fixed to a vehicle body therein at a rotational position shown in FIG. 1.

The pawl 21 is rotatably supported by a pawl axis 24 supported by the base 16 and the resin base 19 and extended in the vertical direction of FIG. 1 corresponding to the width direction of the door 70. The pawl 21 includes a contacting portion 21*a*. The contacting portion 21*a* contacts the latch 20 at the rotational position shown in FIG. 1 to restrict the rotation of the latch 20 in the clockwise direction of FIG. 1.

The operation of the latch mechanism 11 will be explained as follows. FIG. 1 shows a latched state where the door is maintained at a closed state relative to the vehicle body. Under the latched state, the latch 20 is engaged with the striker 23. When the pawl 21 rotates by a predetermined angle in the clockwise direction about the pawl axis 24 from the latched state, the contacting portion 21*a* is disengaged from the latch 20. Accordingly, the latch 20 rotates in the clockwise direction of FIG. 1 by the biasing force of a spring so that the engagement groove 20*a* approximately corresponds to a recess portion 16*a* formed at the base 16. Under this state, the striker 23 can be disengaged from the engagement groove 20*a* in the left direction of FIG. 1 for achieving an unlatched state where the door can be opened relative to the vehicle body. In other words, the latch 20 is disengaged from the striker 23.

Figure 2:
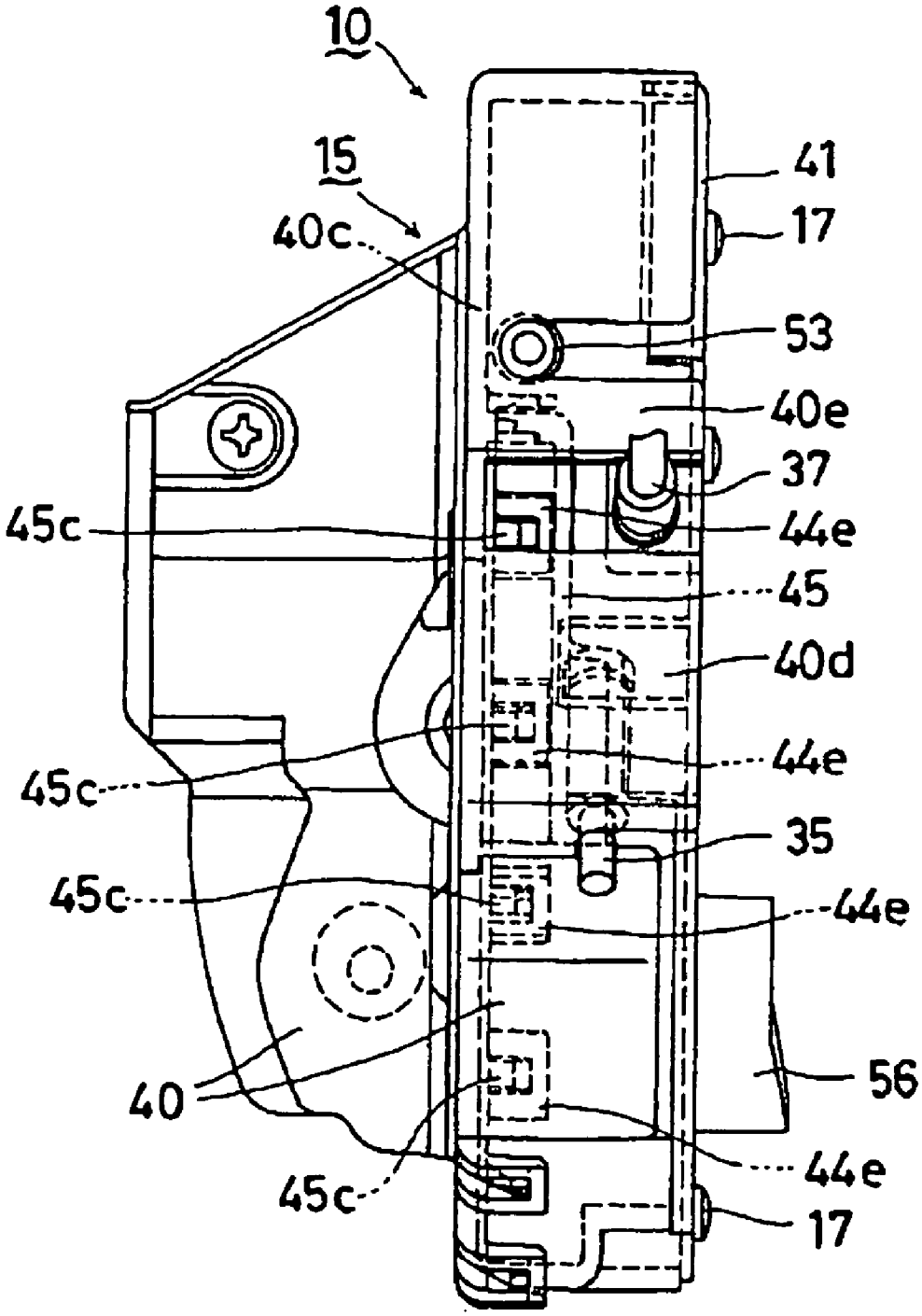
FIG. 2 is a back view of the door lock device shown in FIG. 1.
Figure 4:
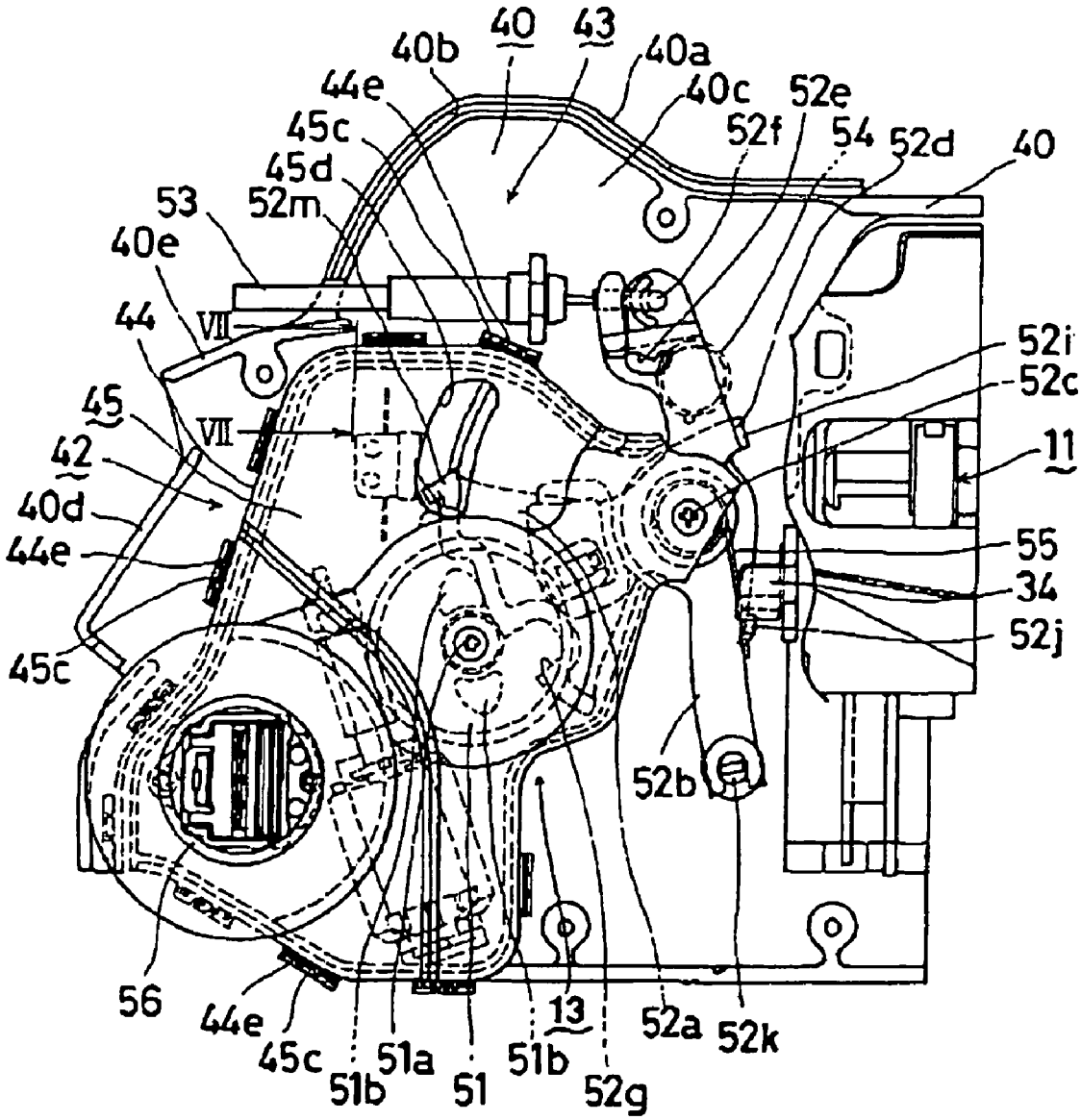
FIG. 4 is a view showing a state without a cover of the door lock device shown in FIG. 3.
Figure 5:
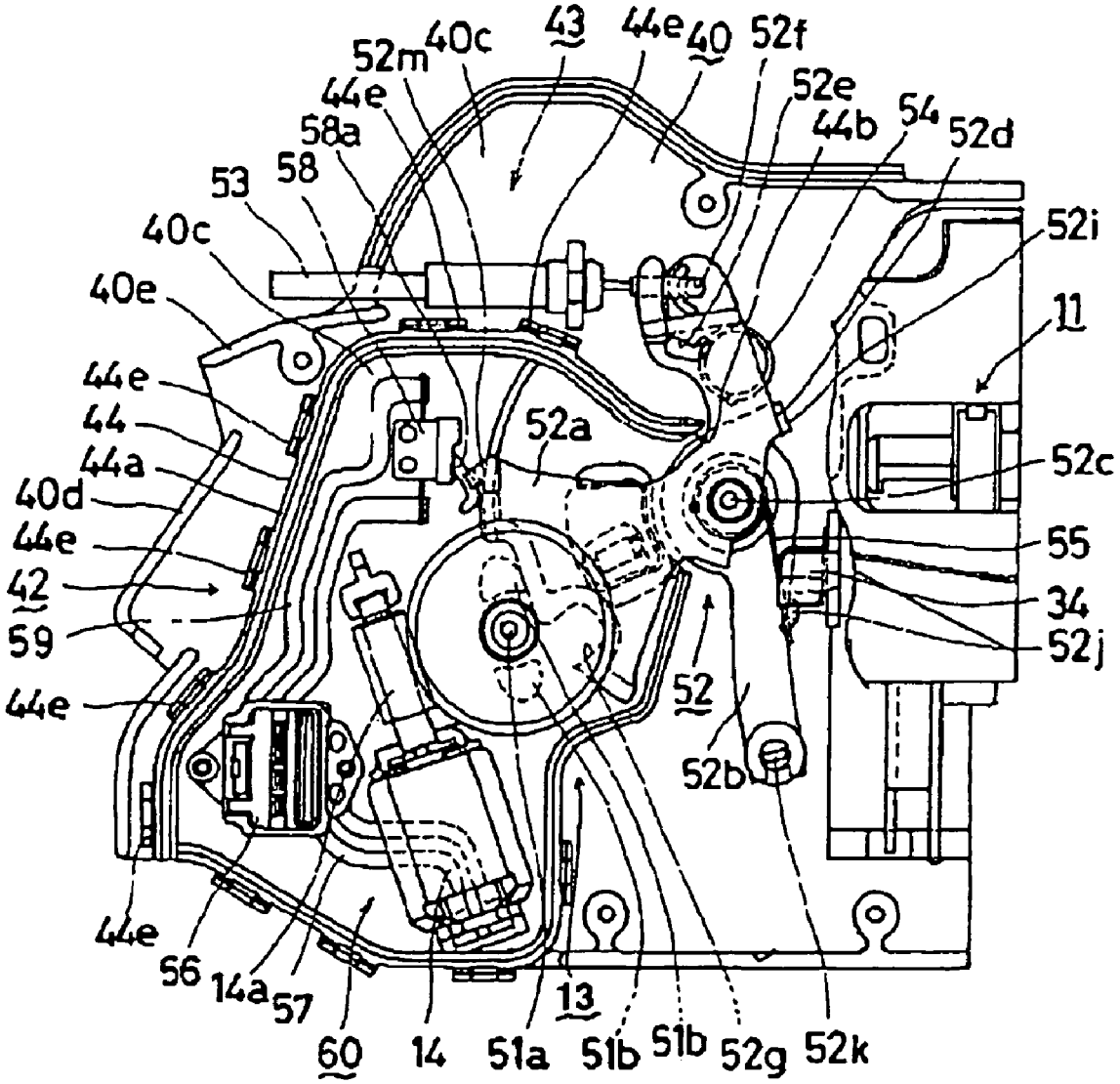
FIG. 5 is a view showing a state without a lid portion of the door lock device shown in FIG. 4.

The construction of the housing 15 will be explained with reference to FIGS. 1–8. FIG. 2 shows a back view of the door lock device 10 shown in FIG. 1. FIGS. 3–5 show the views viewing the door lock device 10 from the interior side (i.e., from left side to the right side of FIG. 1).

As shown in FIG. 2, the housing 15 includes a housing half body 40 for covering the vehicle exterior (i.e., left side of FIG. 2) of a portion such as the lock mechanism 18, and for unitarily covering a vehicle front side of the latch mechanism 11 and a cover 41 assembled to the housing half body 40. In other words, the housing half body 40 includes a reference wall 40*c* extended approximately perpendicular to the thickness direction (i.e., right, left direction of FIGS. 1–2) of the door 70. The cover 41 extends in the direction approximately vertical to the thickness direction (i.e., right, left direction of FIGS. 1–2) of the door 70. The reference wall 40*c* covers the vehicle exterior of the lock mechanism 18, or the like, and the cover 41 covers the interior of the lock mechanism 18, or the like. Although the housing half body 40 and the cover 41 are fixed with four screws 17 as shown in FIG. 3, the method for fixing the housing half body 40 and the cover 41 is not limited.

Figure 6:
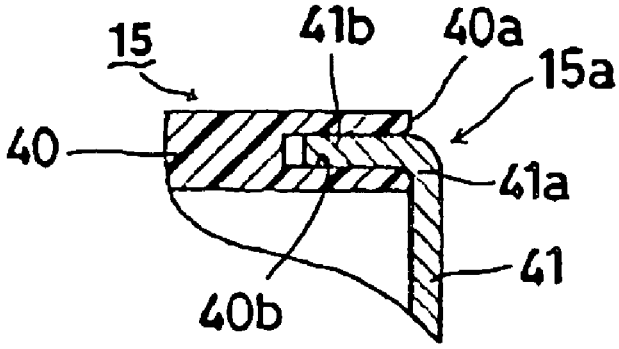
FIG. 6 is a cross-sectional view taken on line VI—VI of FIG. 3.

As shown in FIG. 6, the housing half body 40 includes a groove portion 40*b* hollowed in the left direction of FIG. 6 corresponding to the vehicle outside direction along a rim 40*a* at the top of the housing half body 40. The cover 41 includes a flange portion 41*b* projected in the left direction of FIG. 6 along the rim 41*a* at the top of the housing half body 40. The flange portion 41*b* fits into the groove portion 40*b* when the cover 41 is assembled to the housing half body 40. Thus, for example, comparing to the case the rim 40*a* and the rim 41*a* are assembled by the surface contact, the water unlikely enters from an assembling portion 15*a* of the housing 15. Because the fitting construction between the groove portion 40*b* and the flange portion 41*b* is provided at the top of the housing 15, the water unlikely enters the housing 15 even when the door lock device 10 is subjected to the water from the upper direction. The fitting construction between the groove portion 40*b* and the flange portion 41*b* may be formed at the entire peripheral rim of the housing half body 40 and the cover 41. The fitting construction between the groove portion 40*a* and the flange portion 41*b* may be formed at a rim other than at the top.

Although the housing half body 40 is made of resin and the cover 41 is made of metal with the first embodiment of the present invention, the material used for the housing half body 40 and the cover 41 is not limited. Further, the configuration of the housing half body 40 and the cover 41 is not limited.

As shown in FIGS. 4–5, a case 42 is formed in the housing 15 unitarily with the housing 15. The case 42 is formed to include a space 43 extending from the top of the door 70 (i.e., the top of FIG. 4) to the rear side (i.e., the right of FIG. 4) of the door 70. Although the bottom portions of the case 42 and the housing 15 correspond each other with the construction of the first embodiment, the case 42 may be arranged at a position for forming a space at the bottom of the housing 15.

Figure 7:
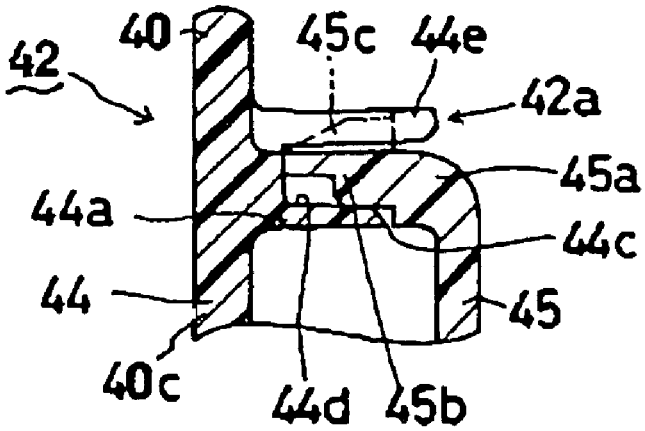
FIG. 7 is a cross-sectional view taken on line VII—VII of FIG. 4.

The construction of the case 42 will be explained as follows. The case 42 includes a case half body 44 and a lid portion 45 so that the lid portion 45 and the case half body 44 are assembled each other. The case half body 44 shares the reference wall 40*c* of the housing half body 40 and includes a wall 44*a* projecting in the vertically front direction of FIG. 5 from the reference wall 40*c*. The wall 44*a* includes a rounded configuration including a recess portion 44*b*. As shown in FIG. 7, the case half body 44 includes a groove portion 44*d* hollowed in the left direction of FIG. 7 corresponding to the vehicle outside direction along a rim 44*c* of the wall 44*a* configuring the external periphery of the case half body 44.

The lid portion 45 is arranged to be in parallel with the reference wall 40*c* and the cover 41. The lid portion 45 extends approximately perpendicular to the thickness direction of the door 70 (i.e., the vertical direction of FIGS. 4–5). The lid portion 45 includes a convex portion 45*b* projecting in the left direction of FIG. 7 along a rim 45*a*. The convex portion 45*b* fits in the groove portion 44*d* when the lid portion 45 is assembled with the case half body 44. Accordingly, the water unlikely enters from an assembling portion 42*a* of the case 42 compared to the case when the rim 44*a* and the rim 45*a* are assembled by the surface contact.

As shown in FIGS. 4–5, 7, the case half body 44 and the lid portion 45 are assembled by connecting detent portions 45*c* formed at the lid portion 45 with plural detent portions 44*e* formed at the case half body 44.

The construction of the lock mechanism 18 and the motor 14 in the housing 15 will be explained with reference to FIGS. 3, 8. The lock mechanism 18 includes the open unit 12 and the lock unit 13. The open unit 12 transmits an opening operational force from an outside handle 72 (shown in FIG. 1) provided at an outer panel 71 (shown in FIG. 1) (i.e., the opening operational force from the vehicle outside) of the vehicle outside of the door 70 and an opening operational force from an inside handle provided at an inner trim 73 (shown in FIG. 1) at the inside of the door 70 (i.e., the opening operational force from the interior) to the latch mechanism 11 for operating the latch mechanism 11 from the engaged state with the striker 23 to the disengaged state from the striker 23. The lock unit 13 transmits a locking and unlocking operational force from a lock knob and the motor 14, or the like, provided at the vehicle interior of the door to the open unit 12. The open unit 12 is operated to assume an unlocked state and a locked state. The open unit 12 can transmit the opening operational force to the latch mechanism 11 under the unlocked state and the opening unit 12 cannot transmit the opening operational force to the latch mechanism 11 under the locked state.

The open unit 12 includes an outside open lever 31 serving as a first lever and an inside open lever 32 serving as a second lever, and an open link 33.

The outside open lever 31 is rotatably supported relative to the cover 41 in the housing 15 about a pin 31*a* serving as a first rotational axis. In other words, the outside open lever 31 rotates about the pin 31*a* serving as a rotational axis arranged approximately in parallel with the vertical direction of FIG. 8 corresponding to the thickness direction of the door 70. The outside open lever 31 includes a connection bore 31*b* at a first end thereof and a connection axis 31*c* at a second end thereof. The connection bore 31*b* is connected with the cable 35 linked to the outside handle 72.

The cable 35 includes an inner cable 35*a* connected with the outside handle 72 at a first end thereof and connected with the connection bore 31*b* at a second end thereof and an outer casing 35*b* for covering the inner cable 35*a*. As shown in FIG. 3, an end portion 35*c* of the outer casing 35*b* is fixed to a fixed flange portion 41*c* of the cover 41. As shown in FIGS. 2–3, the housing half body 40 includes an umbrella portion 40*d* covering the end portion 35*c* from the top. Accordingly, the end portion 35*c* is unlikely subjected to the water and the water unlikely enters in a clearance between the inner cable 35*a* and the outer casing 35*b*.

Figure 8:
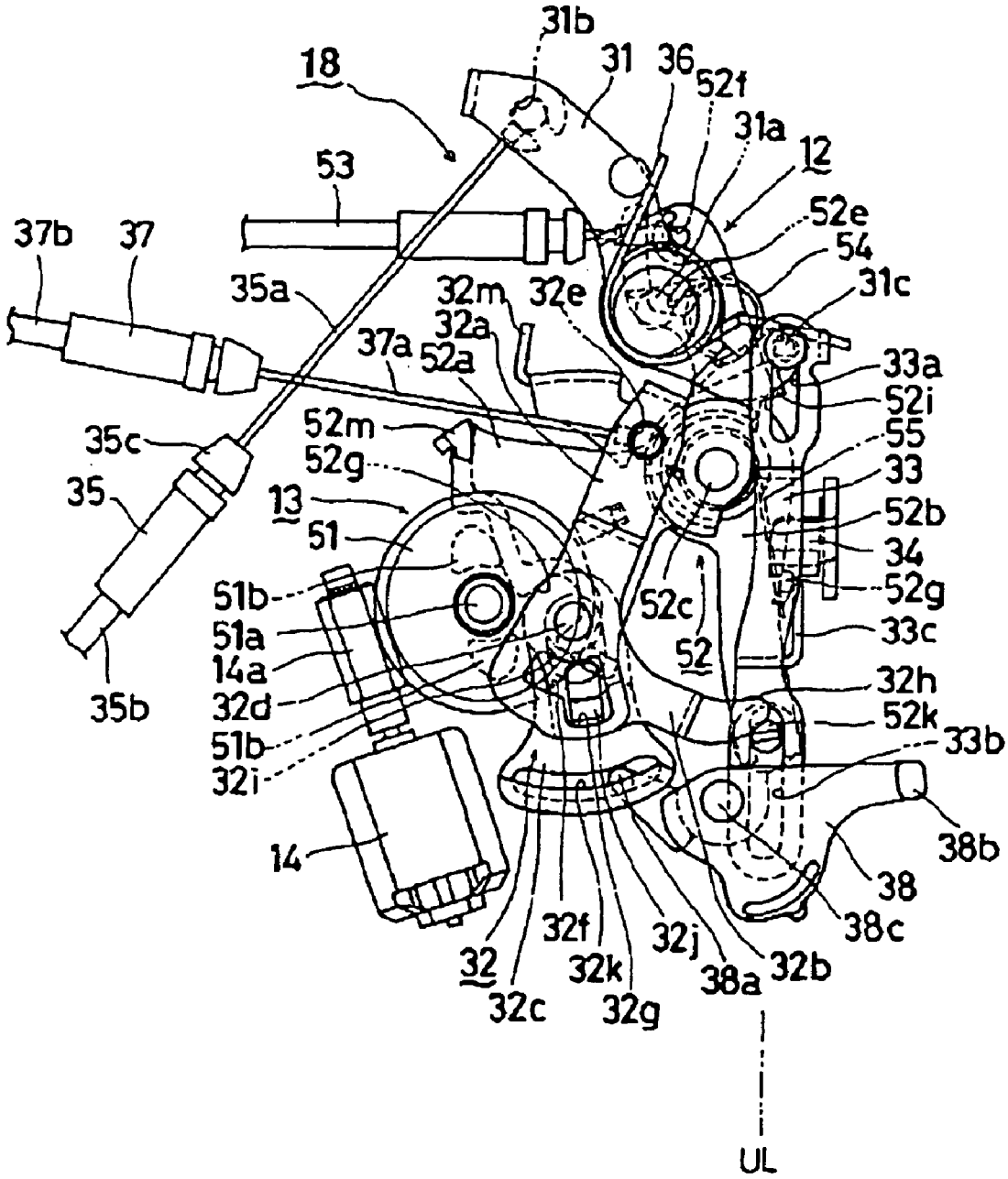
FIG. 8 is a view showing an unlocked state of the door lock device according to the first embodiment of the present invention.

When the outside handle 72 is operated, the outside open lever 31 rotates in the counterclockwise direction of FIG. 8 about the pin 31*a* by the operational force of the outside handle 72. In this case, the connection axis 31*c* moves in the approximately upward direction of FIG. 8.

The inside open lever 32 includes a first inside open lever 32*a*, a second inside open lever 32*b*, and an intermediate lever 32*c*. The first inside open lever 32*a*, the second inside open lever 32*b*, and the intermediate lever 32*c* are rotatably supported by the cover 41 in the housing 15 about a pin 32*d* serving as a second rotational axis. In other words, the inside open lever 32 rotates about the pin 32*d* serving as a rotational axis arranged approximately in parallel with the vertical direction of FIG. 8 corresponding to the thickness direction of the door 70. As shown in FIG. 8, the pin 32*d* is provided as a separate pin from the pin 31*a* of the outside open lever 31. The first inside open lever 32*a* includes a connection bore 32*e* at a first end thereof and a bore 32*f* formed at a second end thereof. The first inside open lever 32*a* includes a cancel flange 32*m* at the left side of FIG. 8 relative to the connection bore 32*e*. A cable 37 linked to the inside handle is connected to the connection bore 32*e*.

The cable 37 includes an inner cable 37*a* connected to the inside handle side at a first end thereof and connected to the connection bore 32*e* at a second end thereof and an outer casing 37*b* for covering the inner cable 37*a*. As shown in FIG. 3, an end portion 37*c* of the outer casing 37*b* is fixed to a fixed flange portion 41*d* of the cover 41. As shown in FIGS. 2–3, the housing half body 40 includes an umbrella portion 40*e* for covering the end portion 37*c* from the top. Accordingly, the end portion 37*c* is unlikely subjected to the water and the water unlikely enters a clearance between the inner cable 37*a* and the outer casing 37*b*.

The second inside open lever 32*b* includes a long bore 32*g* and an engagement end portion 32*h*. The intermediate lever 32*c* includes a long bore 32*i*, an engaging projection 32*j*, and an arc bore 32*k*. The engaging projection 32*j* is located through the long bore 32*g* of the second inside lever 32*b* and the bore 32*f* with anomalous line of the first inside lever 32*a*. A connection shaft 38*a* of a child protector lever 38 rotatably supported by the cover 41 is located through the arc bore 32*k*. When the child protector lever 38 rotates about a pin 32*c* by the operation of an operation portion 38*b*, the intermediate lever 32*c* moves upward and downward of FIG. 8. At the movement of the child protector lever 38, the engaging projection 32*j* relatively moves in the long bore 32*g* and the bore 32*f* with anomalous line and the pin 32*d* relatively moves in the long bore 32*i*.

When the intermediate lever 32*c* is positioned at a position shown in FIG. 8 (i.e., child protector unset state), the entire inside open lever 32 rotates in the counterclockwise direction of FIG. 8 about the pin 32*d* based on the operation of the inside handle. When the intermediate lever 32*c* is moved upward of FIG. 8 to locate the engaging projection 32*j* at a top end of the long bore 32*g* (i.e., child protector set state), the engaging projection 32*j* loses the motion in the bore 32*f* with anomalous line even if the first inside open lever 32*a* rotates based on the operation of the inside handle.

In other words, the intermediate lever 32*c* and the second inside open lever 32*b* do not rotate at the child protector set state.

The open link 33 includes a connection long bores 33*a*, 33*b* at ends thereof and a flange 33*c* having an L shape in cross section. The connection axis 31*c* of the outside open lever 31 is connected to the connection long bore 33*a* at the top. A lift lever 34 linked to the latch mechanism 11 side is provided approximate to the flange 33*c*. A first end of a spring 36 is engaged approximate to the connection long bore 33*a*. A second end of the spring 36 is fixed at the cover 41 side.

The construction of the lock unit 13 will be explained as follows. The lock unit 13 includes a wheel gear 51 and an active lever 52.

The wheel gear 51 including a circular shape is rotatably supported relative to the lid portion 45 with a rotational axis 51*a* (e.g., a screw). As shown in FIGS. 4–5, the wheel gear 51 is accommodated in the case 42 of the housing 15. The wheel gear 51 is formed with a gear at an external periphery thereof. Further, the wheel gear 51 includes two convex portions 51*b*, 51*b* at eccentric positions relative to the rotational axis 51*a* to be projected in the vertical direction of FIG. 4. In other words, the convex portions 51*b*, 51*b* rotates around the rotational axis 51*a* in accordance with the rotation of the wheel gear 51.

The construction of the active lever 52 will be explained as follows. The active lever 52 includes a resin lever 52*a* and a metal lever 52*b*. The resin lever 52*a* and the metal lever 52*b* are supported by the lid portion 45 rotatably about a rotational axis 52*c* (e.g., a screw). As shown in FIG. 5, a portion of the active lever 52 is positioned in the case 42 and the other portion of the active lever 52 is positioned outside of the case 42 via the recess portion 44*b*.

As shown in FIG. 5, the resin lever 52*a* includes a concave portion 52*g*, a pushing portion 52*d*, a bore 52*e* with an anomalous line, a connection bore 52*f*, and an engagement portion 52*m*. The convex portion 51*b* is selectively engaged with the concave portion 52*g* in accordance with the rotation of the wheel gear 51. The cable 53 linked to a lock knob provided at the interior of the door is connected to the connection bore 52*f* of the resin lever 52*a*. A positioning spring 54 fixed at the reference wall 40*c* at a first end thereof and at the bore 52*e* with the anomalous line at a second end thereof is provided at the bore 52*e*. The engagement portion 52*m* projects in the vertically front direction. As shown in FIG. 4, in case the lid portion 45 is assembled, the engagement portion 52*m* extends from the inside of the case 42 to the outside of the case 42 via a long bore 45*d* formed at the lid portion 45 when the lid portion 45 is assembled as shown in FIG. 4.

As shown in FIG. 5, the metal lever 52*b* includes a flange 52*i*, a flange 52*j*, and a boss 52*k*. The pushing portion 52*d* of the resin lever 52*a* contacts the flange 52*i* of the metal lever 52*b*. When the rotational force is applied to the resin lever 52*a* for rotating about the rotational axis 52*c* in the clockwise direction of FIG. 5, the pushing portion 52*d* pushes the flange 52*i* for rotating the active lever 52. A spring 55 is provided between the resin lever 52*a* and the metal lever 52*b* to be fixed at the resin lever 52*a* at a first end thereof, coiled around the rotational axis 52*c*, and fixed at the flange 52*j* of the metal lever 52*b* at a second end thereof. Accordingly, when a torque is applied to the resin lever 52*a* for rotating in the counterclockwise direction of FIG. 5 about the rotational axis 52*c*, the active lever 52 is rotated by the biasing force of the spring 55.

The boss 52*k* of the metal lever 52*b* is connected to the long bore 33*b* of the open link 33 as shown in FIG. 8.

As described in the foregoing explanation for the open unit 12 and the lock unit 13, the door lock device 10 includes the following effects. The outside open lever 31 and the inside open lever 32 included in the open unit 12 rotates at the plane surface approximately perpendicular to the vertical direction of FIG. 8 corresponding to the thickness direction of the door 70. The open link 33 also operates at the plane surface approximately perpendicular to the thickness direction of the door 70 as explained hereafter.

The wheel gear 51 and the active lever 52 included in the lock unit 13 rotates at the plane surface approximately perpendicular to the vertical direction of FIG. 8 corresponding to the thickness direction of the door 70. In other words, the directions of the plane surfaces where the lock unit 13 rotates and the open unit 12 rotates correspond each other to be approximately perpendicular to the thickness direction of the door 70. Thus, the size reduction of the door lock device 10 in the thickness direction of the door 70 is not limited for ensuring the operational range of the open unit 12 and the lock unit 13. Accordingly, the size of the door lock device 10 in the thickness direction of the door 70 can be reduced.

Further, with the open unit 12, the following effects can be obtained. The outside open lever 31 and the inside open lever 32 of the open unit 12 includes the pin 31*a* and the pin 32*d* respectively serving as different rotational axes. Thus, the size of the door lock device 10 in the thickness direction of the door 70 can be reduced compared to the case arranging the outside open lever 31 and the inside open lever 32 to be piled in the axial direction (i.e., the door thickness direction of the door 70).

The outside open lever 31 and the inside open lever 32 are supported by the cover 41. Further, the open link 33 is connected between the connection long bore 33*a* and the connection axis 31*c* relative to the outside open lever 31. When the cover 41 is removed from the door lock device 10, the open unit 12 is removed from the door lock device 10 along with the cover 41 (shown in FIG. 4). As shown in FIG. 4, at the state that the cover 41 is removed from the housing 15, the wheel gear 51 and the active lever 52 included in the lock unit 13 are positioned in the housing half body 40. Thus, the open unit 12 is positioned at the cover 41 side in the housing 15 and the lock unit 13 is positioned at the housing half body 40 side in the housing 15. In other words, the open unit 12 is positioned at the further interior side of the thickness direction of the door 70 (i.e., vertically front side of FIGS. 3–4) compared to the lock unit 13. Accordingly, even when an object collides with the vehicle at the vehicle outside of the door 70, the open unit 12 is unlikely damaged to ensure the stable operation of the door lock device 10. Particularly, with the door lock device 10, the open unit 12 including the outside open lever 31 linked to the outside handle 72 is positioned at the further interior side. Thus, even at the collision of the object to the outside of the door 70, the open unit 12 including the outside open lever 31 is unlikely damaged.

The construction of the motor 14 will be explained as follows. As shown in FIG. 5, the motor 14 is fixed to the reference wall 40*c* in the case 42. The motor 14 is connected to a connector 56 fixed to the reference wall 40*c* in the case 42 via a bus bar 57 (shown in FIG. 5). As shown in FIG. 3, the connector 56 is connectable from the outside of the housing 15. With the foregoing construction, the motor 14 is driven by the power supply from a CPU, or the like, from the outside of the door lock device 10. A warm gear 14*a* is provided at an output shaft of the motor 14. The warm gear

14*a* is geared with the wheel gear 51 for rotating the wheel gear 51 in a normal and a reverse direction in accordance with the actuation of the motor 14. The motor 14 operates the wheel gear 51 for eventually switching the locked state and the unlocked state of the door lock device 10 by operating the active lever 52. The motor 14 outputs the locking and unlocking operational force for the door lock device 10.

As shown in FIG. 5, a position switch 58 is fixed to the reference wall 40*c* in the case 42. The position switch 58 includes a switch piece 58*a* selectively engaging with the resin lever 52*a* of the active lever 52 for detecting the rotational position of the active lever 52. The rotational position of the active lever 52 determines the unlocked state and the locked state of the door lock device 10. Thus, the position switch 58 serves as a switch for detecting the unlocked state and the locked state of the door lock device 10. The position switch 58 is connected to the connector 56 via a bus bar 59 (shown in FIG. 5). The state of the door lock device 10 detected by the position switch 58 is transmitted to the CPU, or the like, outside of the door lock device 10 via the connector 56.

Electrical components 60 such as the motor 14, the connector 56, the position switch 58, and the bus bars 57, 59 are accommodate in the case 42 in the housing 15. The case 42 is formed to include the space 43 at least at the top of the housing 15. Thus, the electrical components such as the motor 14 are covered with plural members such as the housing 15 and the case 42 viewing the door lock device 10 from the top. Accordingly, even when the door lock device 10 is subjected to the water from the top, the water resistance in the case 42 is favorable.

The operation of the door lock device 10 will be explained with reference to FIGS. 8–16. FIGS. 8–16 show the open unit 12, the lock unit 13, and the motor 14.

Figure 9:
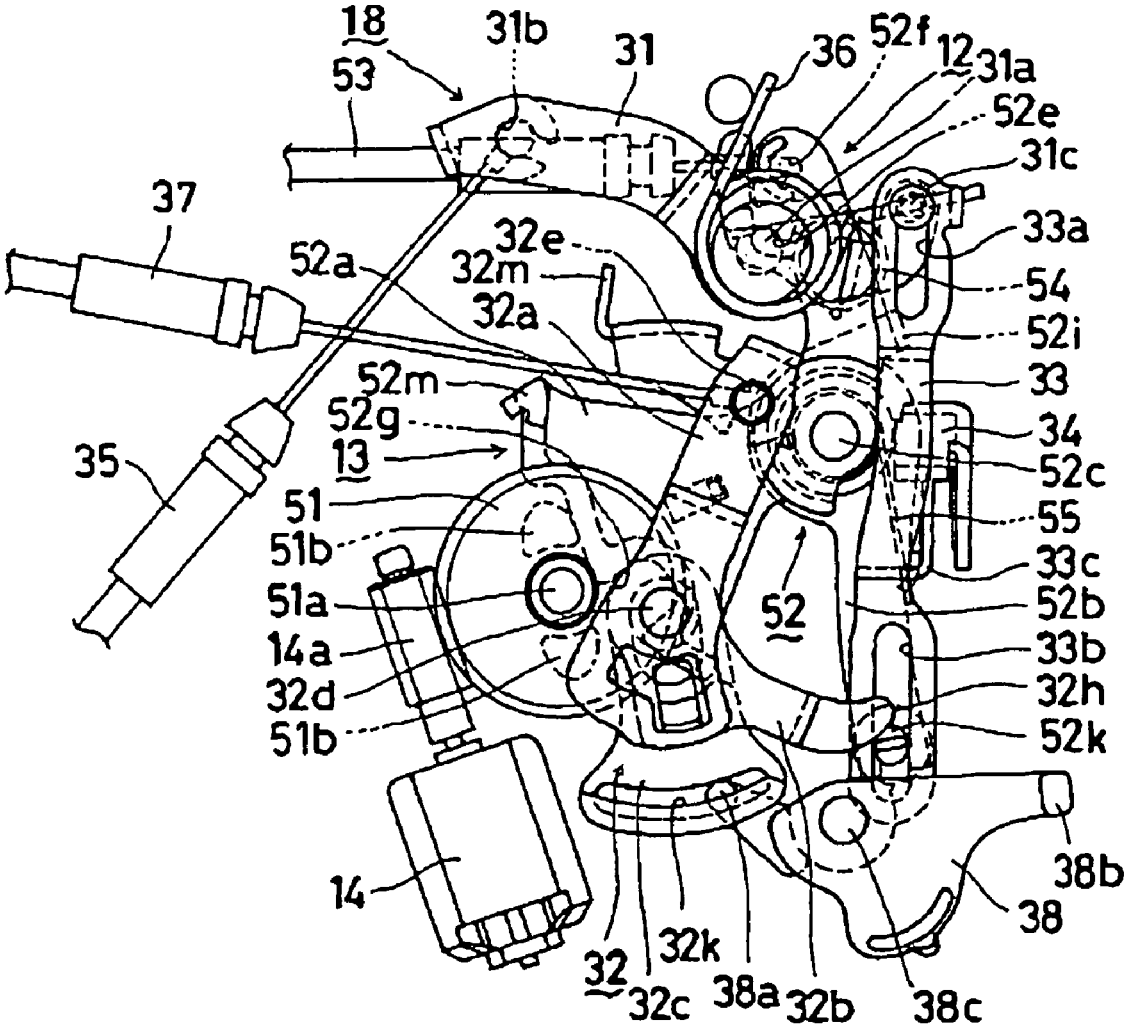
FIG. 9 is a view showing a state at an outside opening operation of the door lock device shown in FIG. 8.

The opening operation at the unlocked state will be explained as follows. FIG. 8 shows the unlocked state when the entire active lever 52 and the open link 33 are at the unlocked position (UL). In case the outside open lever 31 rotates in the counterclockwise direction about the pin 31*a* based on the operation of the outside handle at the unlocked state, the open link 33 moves approximately upward direction of FIG. 8. Thereafter, the flange 33*c* of the open link 33 is engaged with the lift lever 34 for moving the lift lever 34 upward of FIG. 8. The lift lever 34 is unitarily rotatably supported at the pawl axis 24 of the pawl 21. Thus, when the lift lever 34 moves upward, the pawl 21 rotates in the clockwise direction of FIG. 1 for operating the latch mechanism 11 from the latched state to the unlatched state. The state after the foregoing operation is shown in FIG. 9.

Figure 10:
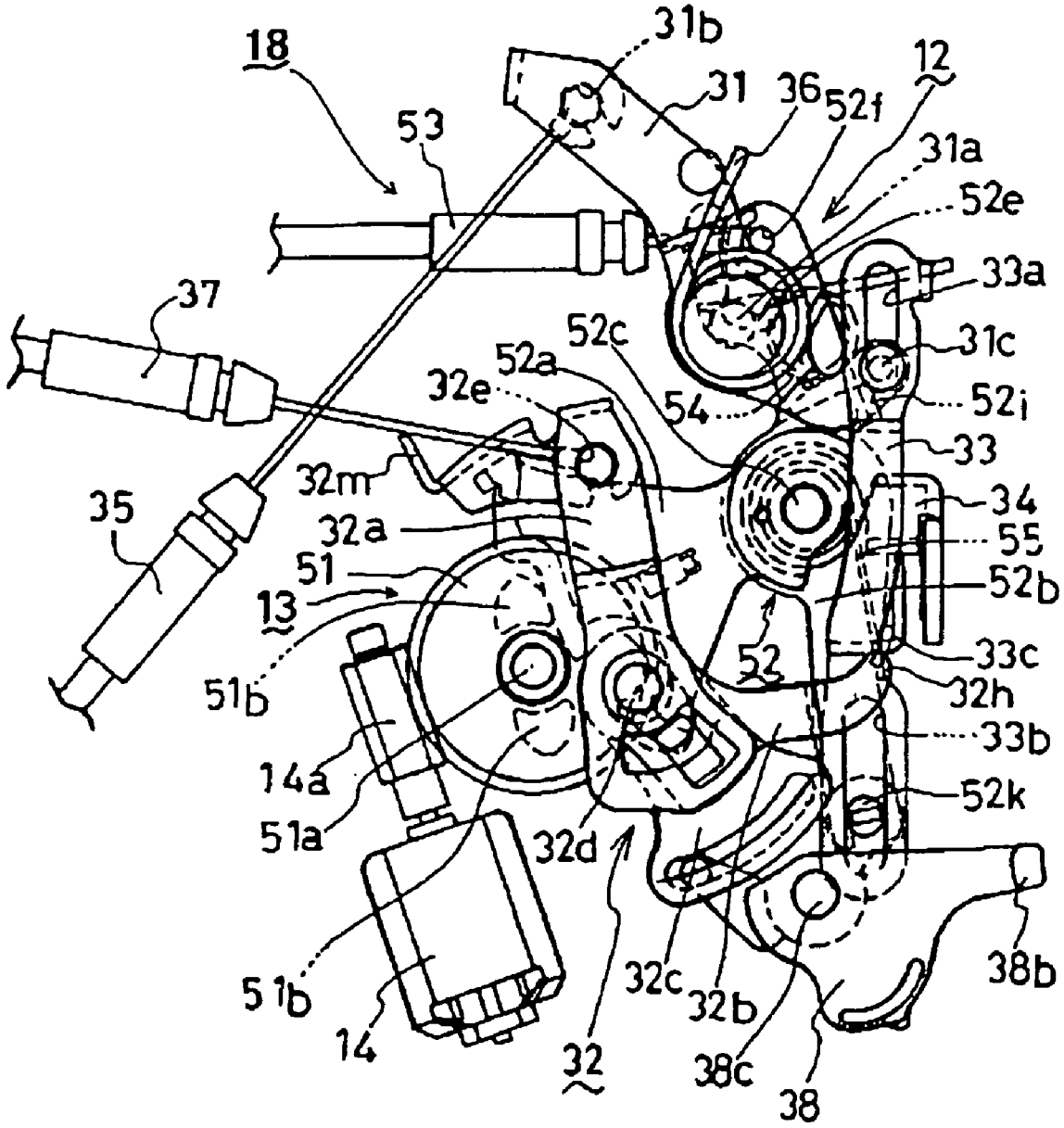
FIG. 10 is a view showing a state at an inside opening operation of the door lock device shown in FIG. 8.

In case the entire inside open lever 32 rotates in the counterclockwise direction about the pin 32*d* in accordance with the operation of the inside handle at the unlocked state shown in FIG. 8, the engagement end portion 32*h* of the second inside open lever 32*b* is engaged with the flange 33*c*. Thereafter, the open link 33 moves upward of FIG. 8. Likewise at the operation of the outside handle, in this case, the flange 33*c* of the open link 33 is engaged with the lift lever 34 to move the lift lever 34 upward of FIG. 8. Accordingly, the latch mechanism 11 is operated from the latched state to the unlatched state. The state after the foregoing operation is shown in FIG. 10.

The locking operation and the unlocking operation will be explained as follows. In case the motor 14 is driven at the unlocked state shown in FIG. 8, the door lock device 10 is operated as follows. When the wheel gear 51 rotates in the counterclockwise direction by the actuation of the motor 14 from the state of FIG. 8, the convex portion 51*b* is engaged with the concave portion 52*g* of the resin lever 52*a*. The resin lever 52*a* rotates in the clockwise direction of FIG. 8 about the rotational axis 52*c*. When the resin lever 52*a* rotate, the pushing portion 52*d* pushes the flange 52*i* for rotating the active lever 52. Accordingly, the open link 33 moves due to the connection between the boss 52*k* of the metal lever 52*b* and the connection long bore 33*b* of the open link 33. In other words, the open link 33 rotates in the clockwise direction of FIG. 8 by a predetermined angle about the connection axis 31*c* of the outside open lever 31 from the unlocked state. The state after the foregoing operation is the locked state of the door lock device 10 where the entire active lever 52 and the open link 33 position at the locked position (L) (shown in FIG. 11). The locking operation may be performed in accordance with the operation of, for example, the lock knob via the cable 53 by the rotation of the entire active lever 52 about the rotational axis 52*c*.

Figure 11:
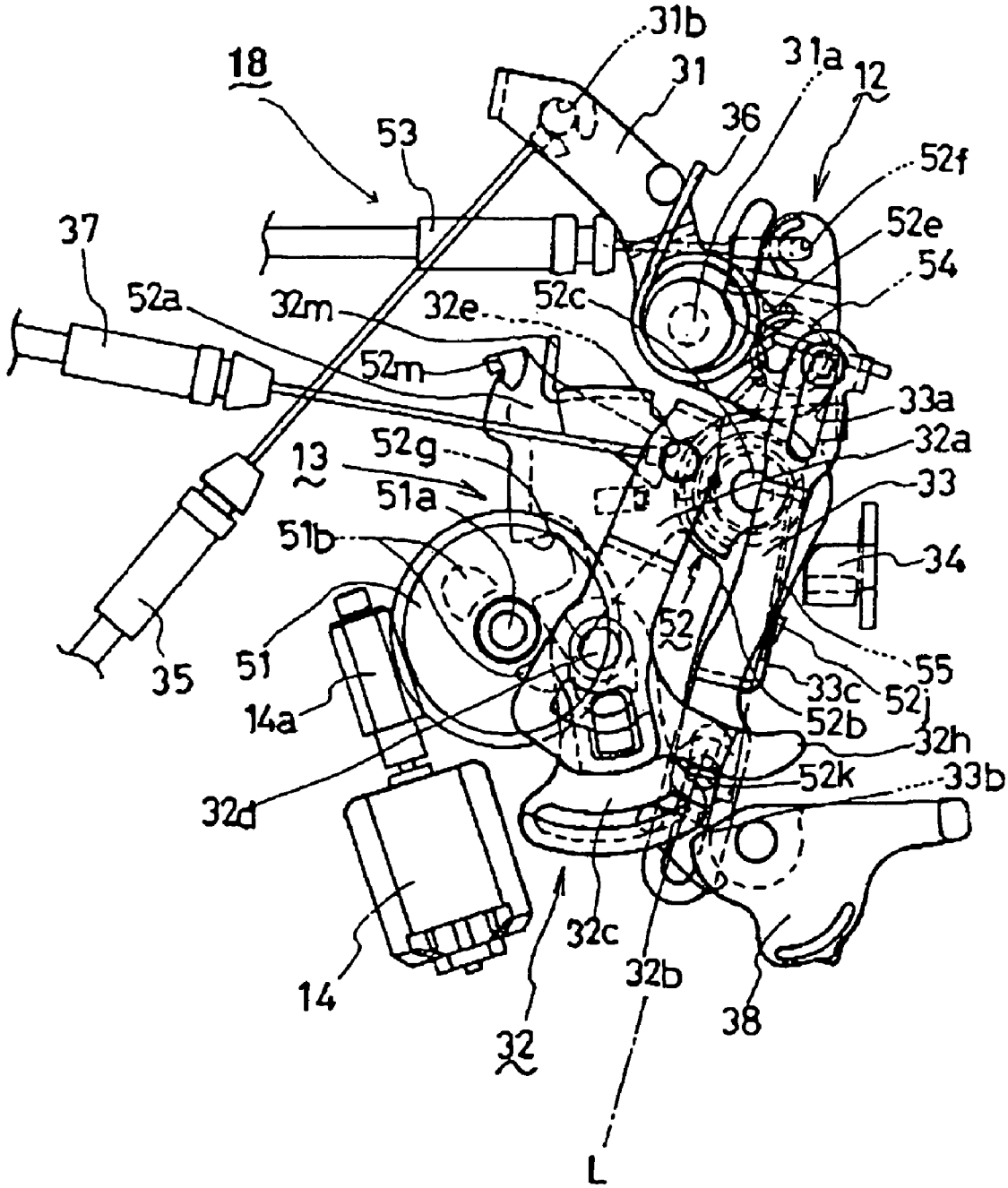
FIG. 11 is a view at a state switched to a locked state of the door lock device shown in FIG. 8.

When the wheel gear 51 rotates in the clockwise direction of FIG. 8 by the actuation of the motor 14 at the locked state shown in FIG. 11, the convex portion 51*b* is engaged with the concave portion 52*g* of the resin lever 52*a*. Thereafter, the resin lever 52*a* rotates in the counterclockwise direction about the rotational axis 52*c*. As a result, the entire active lever 52 rotates by the biasing force of the spring 55. Thereafter, due to the connection between the boss 52*k* of the metal lever 52*b* and the connection long bore 33*b* of the open link 33, the open link 33 is moved to be the unlocked state shown in FIG. 8. The unlocking operation may be operated based on the operation of the lock knob. With the foregoing operation, the active lever 52 and the open link 33 are selectively positioned at two positions including the unlocked position and the locked position.

Figure 12:
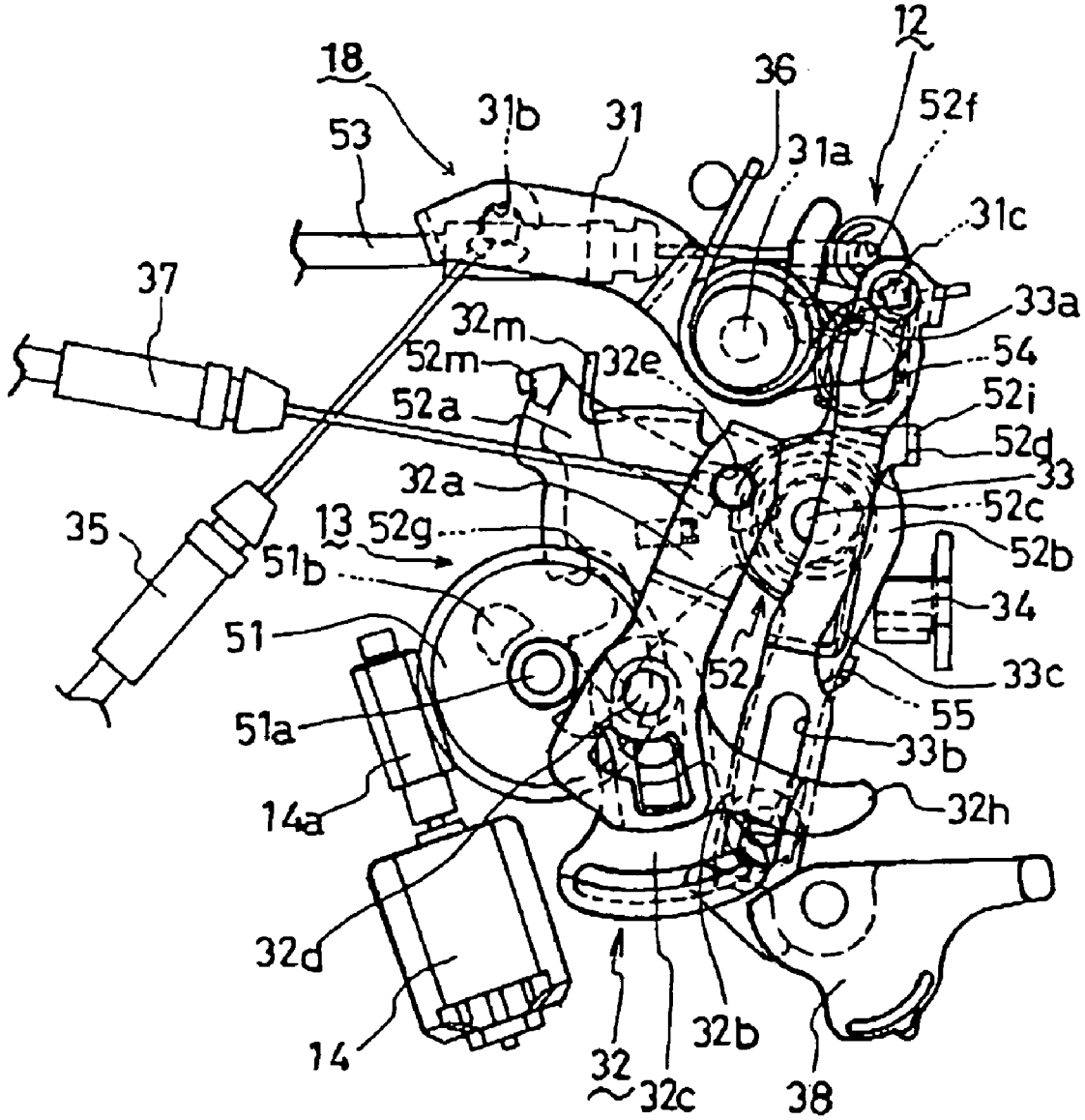
FIG. 12 is a view showing a state at the outside opening operation of the door lock device shown in FIG. 11.

The outside opening operation at the locked state will be explained as follows. In case the outside handle 72 is operated at the locked state shown in FIG. 11, the door lock device 10 is operated as follows. When the outside open lever 31 rotates in the counterclockwise direction of FIG. 11, the open link 33 moves approximately upward of FIG. 11. Notwithstanding, a moving locus of the flange 33*c* along with the movement of the open link 33 is off from the lift lever 34. In other words, the flange 33*c* does not contact the lift lever 34. Accordingly the latch mechanism 11 does not operate from the latched state to the unlatched state even at the rotation of the outside open lever 31. The state after the foregoing operated is shown in FIG. 12. In case the outside handle 72 returns from the state shown FIG. 12, the outside open lever 31 rotates in the clockwise direction by the biasing force of the spring 36 to be the state shown in FIG. 11.

The inside opening operation at the locked state will be explained as follows. In case the inside handle is operated at the locked state shown in FIG. 11, the door lock device 10 is operated as follows. When the entire inside open lever 32 rotates in the counterclockwise direction, the cancel flange 32*m* of the first inside open lever 32*a* is engaged with the engagement portion 52*m* of the resin lever 52*a* of the active lever 52 to push the engagement portion 52*m* in the bottom left direction of FIG. 11. Because the engagement portion 52*m* extends outside of the case 42 via the long bore 45*d* of the lid portion 45, the cancel flange 32*m* is engaged with the engagement portion 52*m*. The state after the foregoing operation is shown in FIG. 13.

Figure 13:
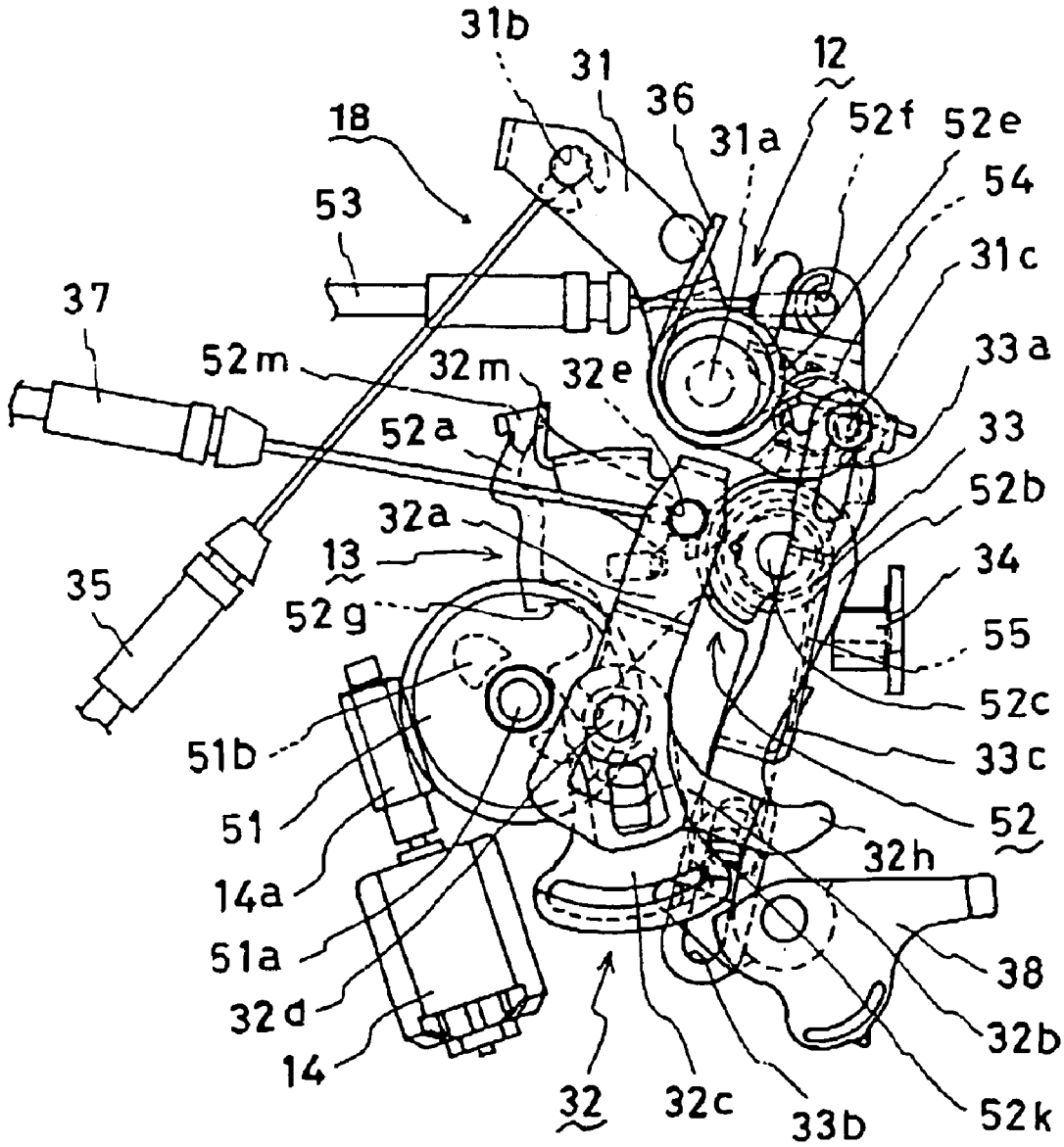
FIG. 13 is a view showing a state at the inside opening operation of the door lock device shown in FIG. 11.

In case the inside open lever 32 further rotates in the counterclockwise direction from the state shown in FIG. 13, the resin lever 52*a* engages with the inside open lever 32 to operate together. Accordingly, the entire active lever 52 rotates in the counterclockwise direction about the rotational axis 52*c* to move the entire active lever 52 and the open link 33 to the unlocked position. The state after the foregoing operation is shown in FIG. 14.

Figure 14:
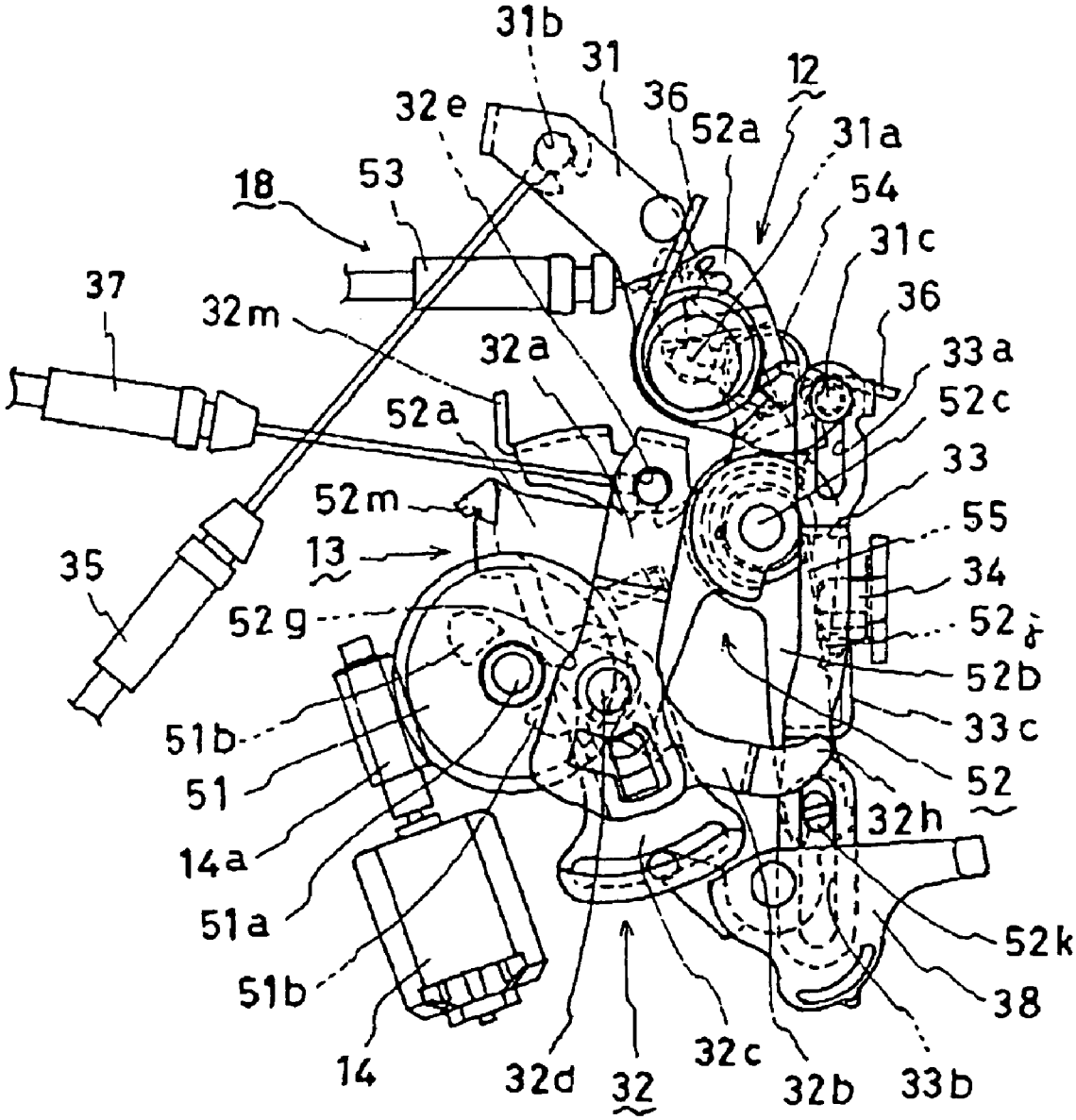
FIG. 14 is a view showing a state at the further inside opening operation of the door lock device shown in FIG. 13.

At the state shown in FIG. 14, the engagement end portion 32*h* of the second inside open lever 32*b* is selectively engaged with the flange 33*c* to move upward relative to the flange 33*c*. Thus, in case the entire inside open lever 32 further rotates in the counterclockwise direction about the pin 32*d*, the open link 33 moves approximately upward of FIG. 14. Because the flange 33*c* is selectively engaged with the lift lever 34 to move upward relative to the lift lever 34, the latch mechanism 11 operates from the latched state to the unlatched state.

As foregoing, with the embodiment of the present invention, the door lock device includes a one-motion function for establishing the switching operation to the unlocked state and to the opening operation by a single operation of the inside handle.

The unlocking operation after opening operation at the locked state will be explained as follows. The operation when the switching operation from the locked state shown in FIG. 11 to the unlocked state by the operation of the outside handle 72 and by the motor 14 is overlapped or consecutively operated will be explained as follows. The overlapping or the consecutive operation of the outside handle 72 and the motor 14 for switching the locked state to the unlocked state may be operated, for example, when a door lock system as it called smart entry system is adopted. With the smart entry system, the door lock device is switched from the locked state to the unlocked state by the actuation of the motor 14 by the CPU of the vehicle by detecting the user (i.e., key holder) approaching a hand, or the like, to the outside handle 72 under the state that the user is positioned close to the vehicle is detected by a capacitance sensor, or the like. With the smart entry system, the user may operate the outside handle 72 before switching the state of the door lock device to the unlocked state by the motor 14.

When the outside handle 72 is operates from the state shown in FIG. 11, the state assumes likewise as shown in FIG. 12. When the wheel gear 51 rotates in the clockwise direction of FIG. 12 by the further actuation of the motor 14, the active lever 52 and the open link 33 are engaged to move to the unlocked position direction together. Thereafter, the flange 33*c* of the open link 33 is engaged with the lift lever 34 positioned at the right direction. The state after the foregoing operation is shown in FIG. 15.

Figure 15:
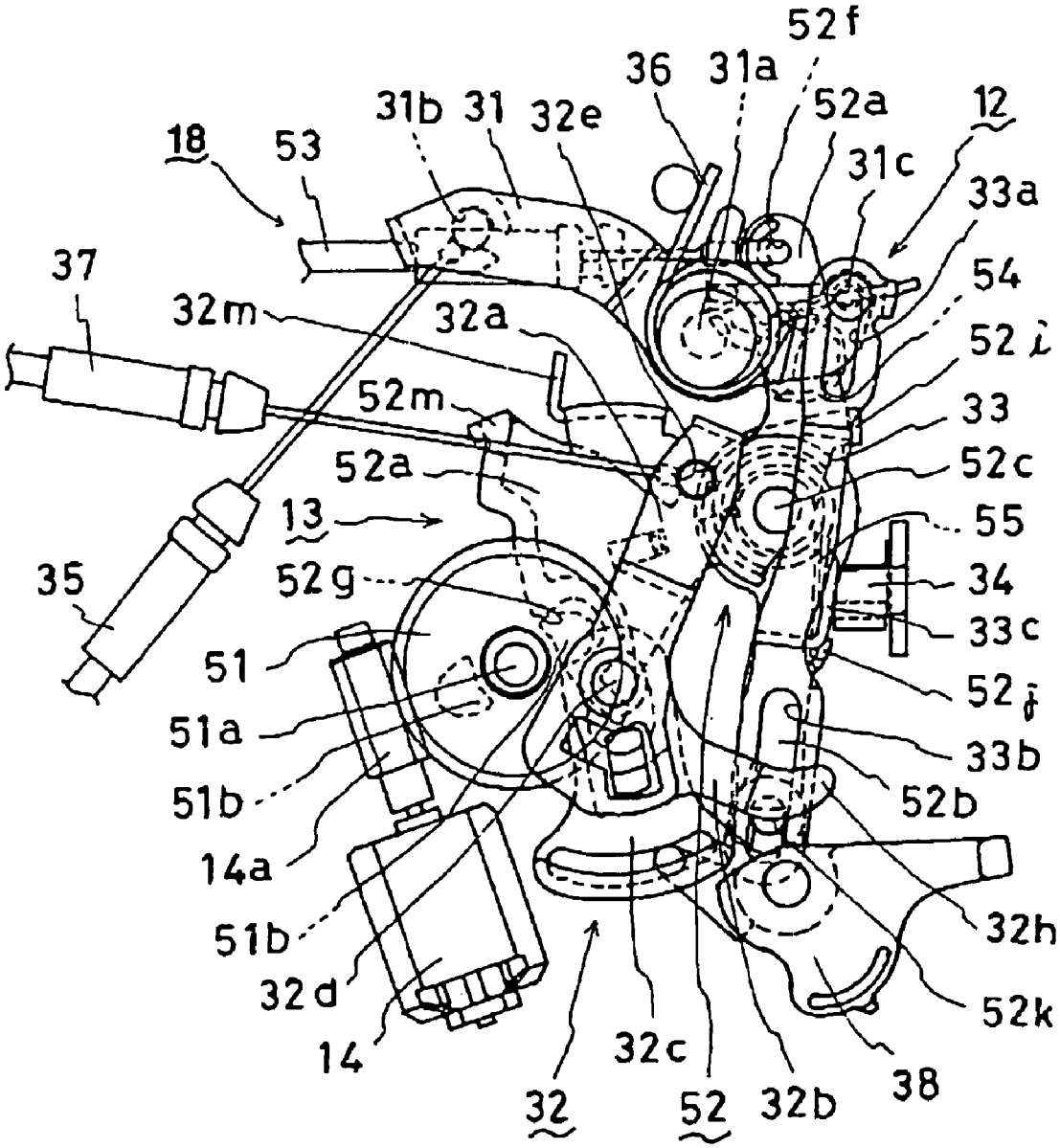
FIG. 15 is a view at a state switched to the unlocked state of the door lock device shown in FIG. 12.

Although the open link 33 is likely to move further in the right direction shown in FIG. 15 corresponding to the unlocked position at the state shown in FIG. 15, the movement of the open link 33 is restricted by the engagement of the flange 33*c* with the lift lever 34. The active lever 52 includes the resin lever 52*a* and the metal lever 52*b*. The spring 55 is provided between the resin lever 52*a* and the metal lever 52*b*. Thus, the resin lever 52*a* is movable relative to the metal lever 52*b* against the biasing force of the spring 55. Although the resin lever 52*a* keeps rotating in the counterclockwise direction of FIG. 15 about the rotation axis 52*c* in accordance with the further rotation of the wheel gear 51, the operation of the open link 33 and the metal lever 52*b* connected to the open link 33 is restricted by the lift lever 54. The state after the foregoing operation is shown in FIG. 16.

Figure 16:
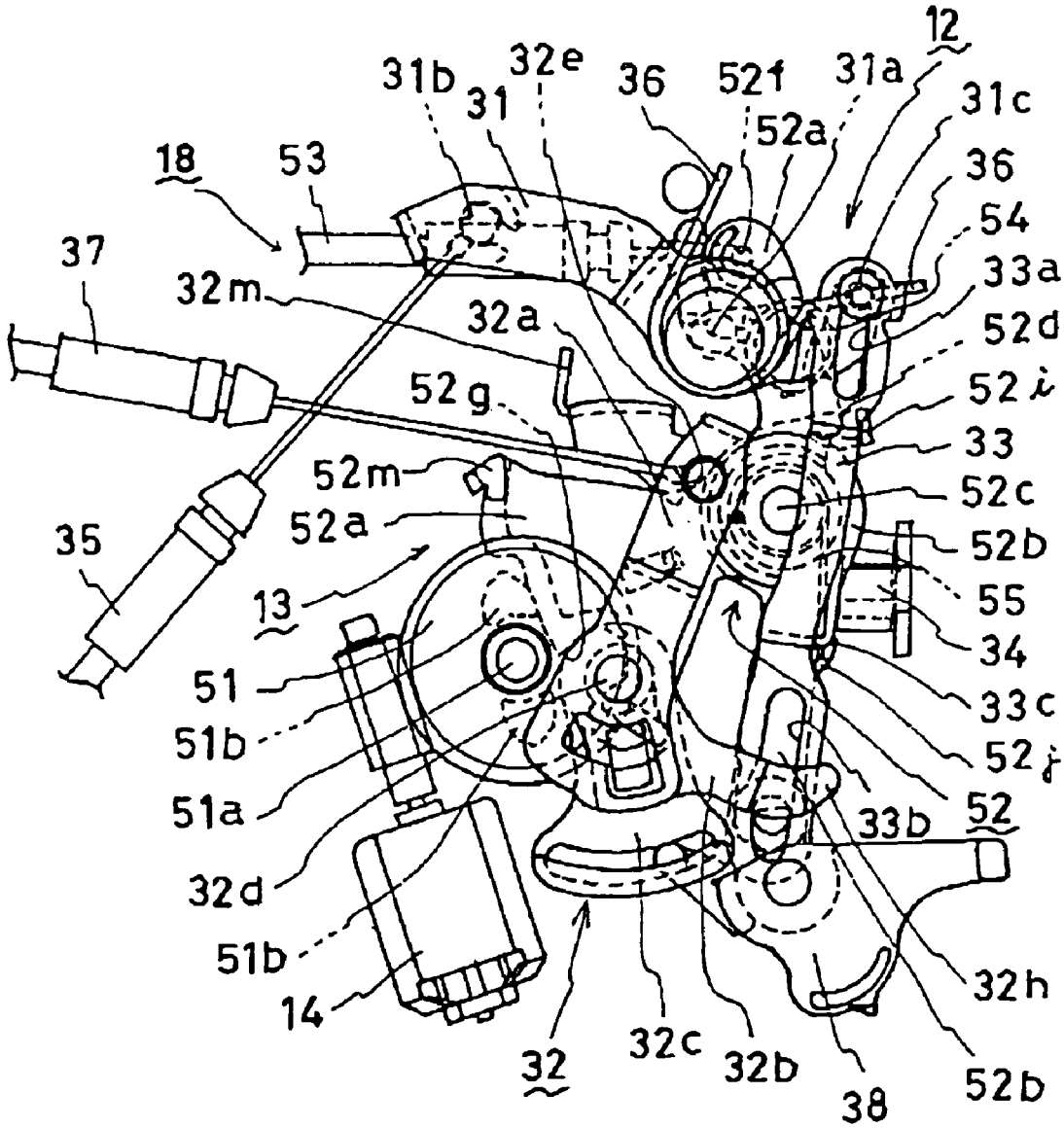
FIG. 16 is a view at a state switched to the further unlocked state of the door lock device shown in FIG. 15.

When the operation of the outside handle 72 returns from the state shown in FIG. 16, the open link 33 moves approximately downward of FIG. 16. By the disengagement between the flange 33*c* and the lift lever 34, the metal lever 52*b* and the open link 33 move to the unlocked state by the biasing force of the spring 55. Thus, the unlocked stated shown in FIG. 8 is achieved.

As foregoing, with the door lock device 10, the state can be switched to the unlocked state by returning the operation of the outside handle 72 even at the overlapping or consecutive operation of the opening operation by the outside handle 72 and the unlocking operation to the unlocked state at the locked state. Thus, without the switching operation to the unlocked state second time, the state can be changed to be unlatched state by operating the outside handle 72. This achieves the high oepratively.

Figure 17:
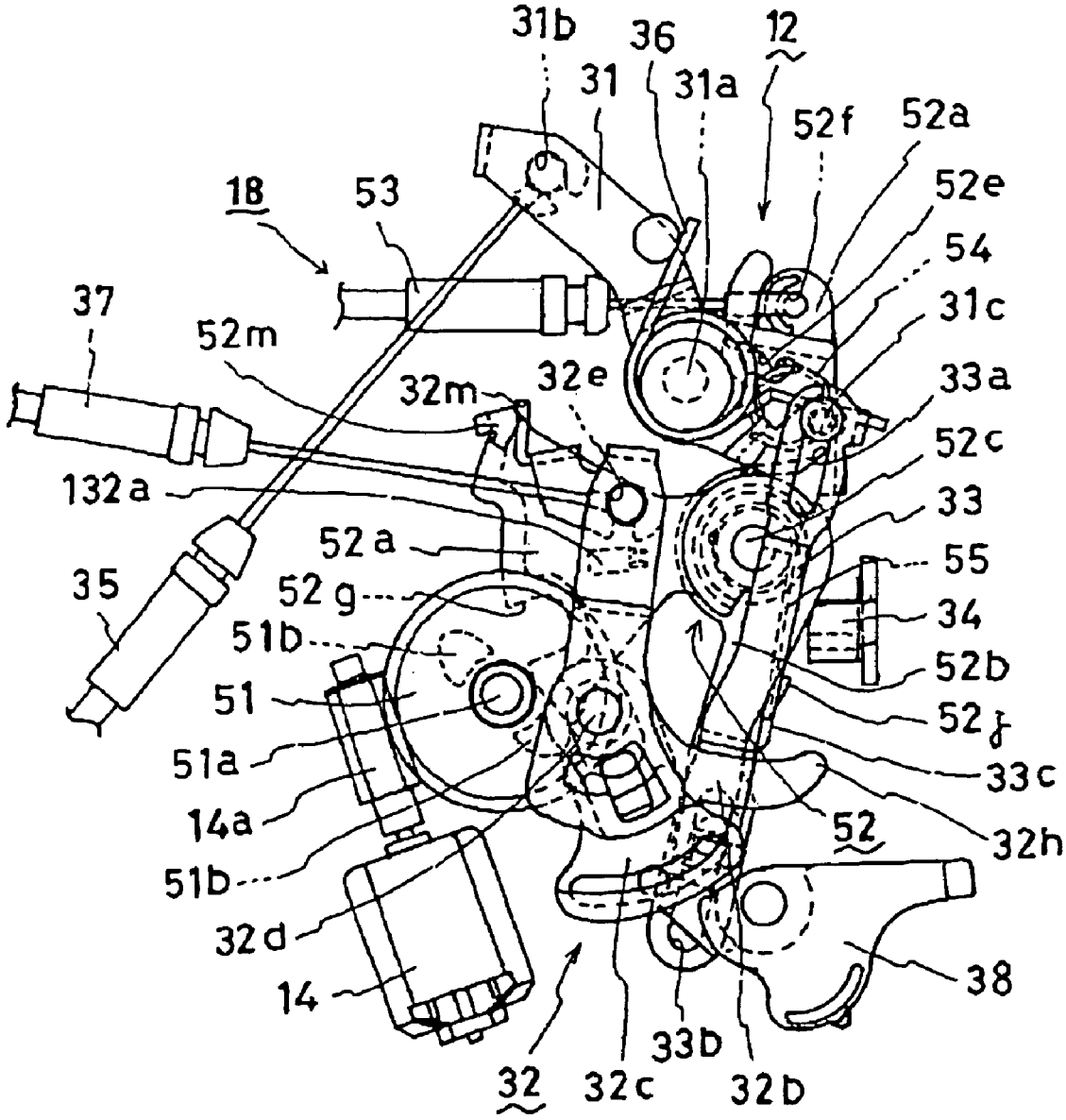
FIG. 17 is a view showing a state at the inside opening operation at the locked state of the door lock device according to a second embodiment of the present invention.

A second embodiment of the present invention will be explained with reference to FIGS. 17–18. The configuration of a first inside open lever 132*a* of the inside open lever 32 of the second embodiment is different from the configuration of the first inside open lever 32*a* of the first embodiment. A distance from the connection bore 32*e* of the first inside open lever 132*a* to the cancel flange 32*m* is shorter than a distance from the connection bore 32*e* of the first inside open lever 32*a* to the cancel flange 32*m* of the first embodiment. The explanations for the construction of other members of the second embodiment corresponding to the first embodiment is not repeated.

The inside opening operation at the locked state of the second embodiment will be explained as follows. When the inside handle is operated from the locked state corresponding to the state shown in FIG. 11, the door lock device operates as follows. In case the entire inside open lever 32 rotates in the counterclockwise direction, the cancel flange 32*m* of the first inside open lever 132*a* is engaged with the engagement portion 52*m* of the resin lever 52*a* of the active lever 52 to push the engagement portion 52*m* in the approximate bottom left direction. The state after the foregoing operation is shown in FIG. 17.

In accordance with the further operation of the inside open lever 32, the second inside open lever 32*b* is engaged with the flange 33*c* of the open link 33 to push the flange 33*c* in the approximately upward direction thus to move the open link 33 approximately upward. Because the distance from the connection bore 32*e* to the cancel flange 32*m* is short, the moving timing of the open link 33 in the unlocked position direction relative to the movement of the open link 33 in the upward direction is delayed compared to the moving timing of the open link 33 in the unlocked position direction of the first embodiment. Thus, the flange 33*c* of the open link 33 is engaged with the lift lever 34 positioned at the approximately right direction. By this engagement, the movement of the open link 33 in the approximately right direction is restricted. However, likewise the unlocking operation after the opening operation at the locked state of the first embodiment, the resin lever 52*a* of the active lever 52 rotates in the counterclockwise direction about a rotational axis 52*c* against the biasing force of the spring 55. The state after the foregoing operation is shown in FIG. 18.

Figure 18:
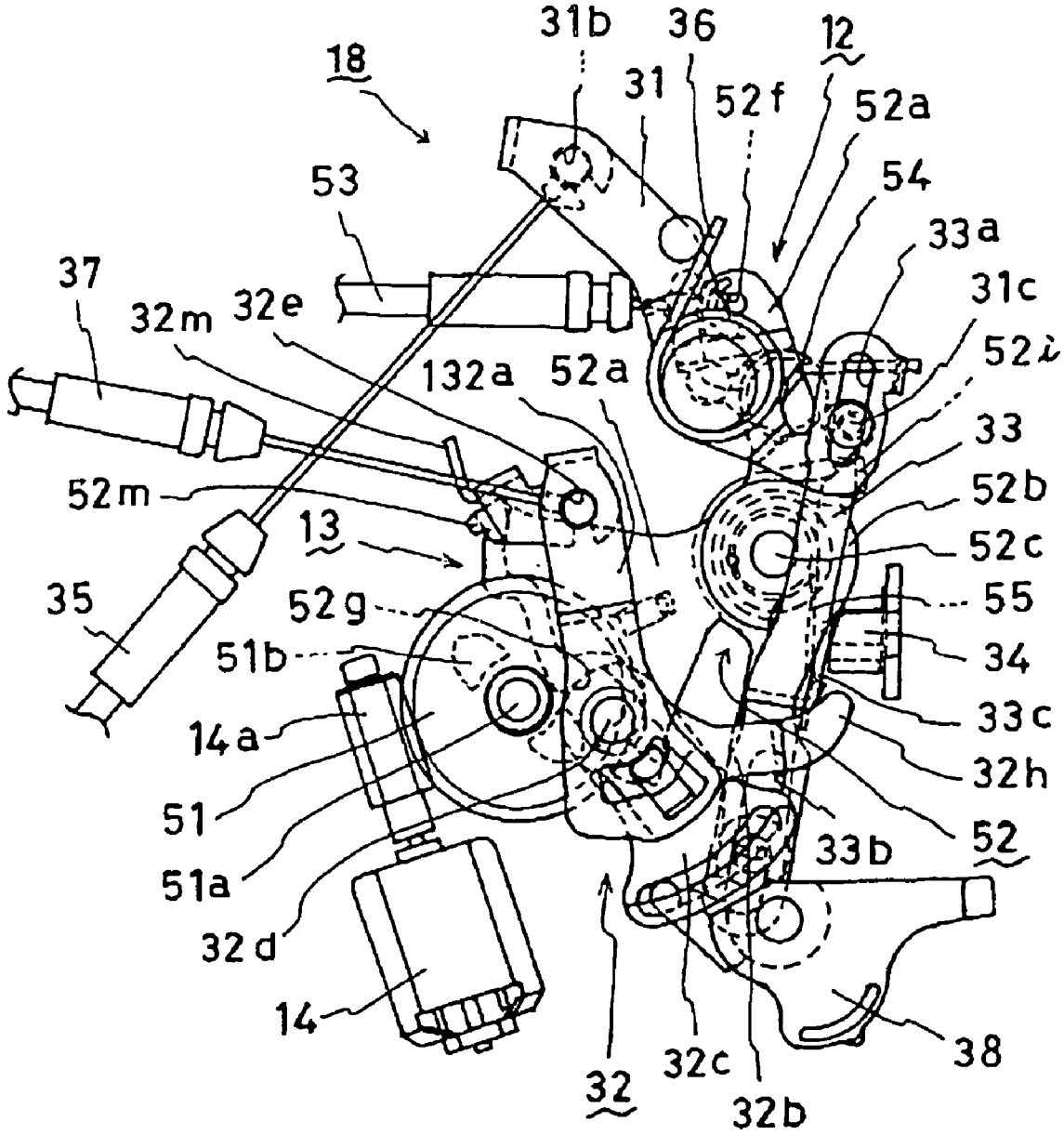
FIG. 18 is a view showing a state at the further inside opening operation of the door lock device shown in FIG. 17.

Returning the operation of the inside handle from the state of FIG. 18, the open link 33 moves approximately downward of FIG. 18. By the disengagement of the flange 33*c* from the lift lever 34, the metal lever 52*b* and the open link 33 move to the unlocked position by the biasing force of the spring 55. Thus, the unlocked state corresponding to FIG. 8 is achieved. By operating the inside handle second time, the normal opening operation is achieved to operate the latch mechanism 11 from the latched state to the unlatched state.

With the construction of the second embodiment, the door lock device includes a two-motion function for establishing the switching operation to the unlocked state and the opening operation by operating the inside handle twice. Accordingly, likewise the first embodiment, the one motion function and the two motion function can be switched only by changing the configuration of the inside open lever 32 slightly.

A third embodiment of the present invention will be explained with reference to FIGS. 19–27. The door lock device of the third embodiment includes an outside open lever 231, an inside open lever 232, and an open link 233 with different configuration from the door lock device of the first embodiment. The explanations for the common constructions with the first embodiment will not be repeated.

Figure 19:
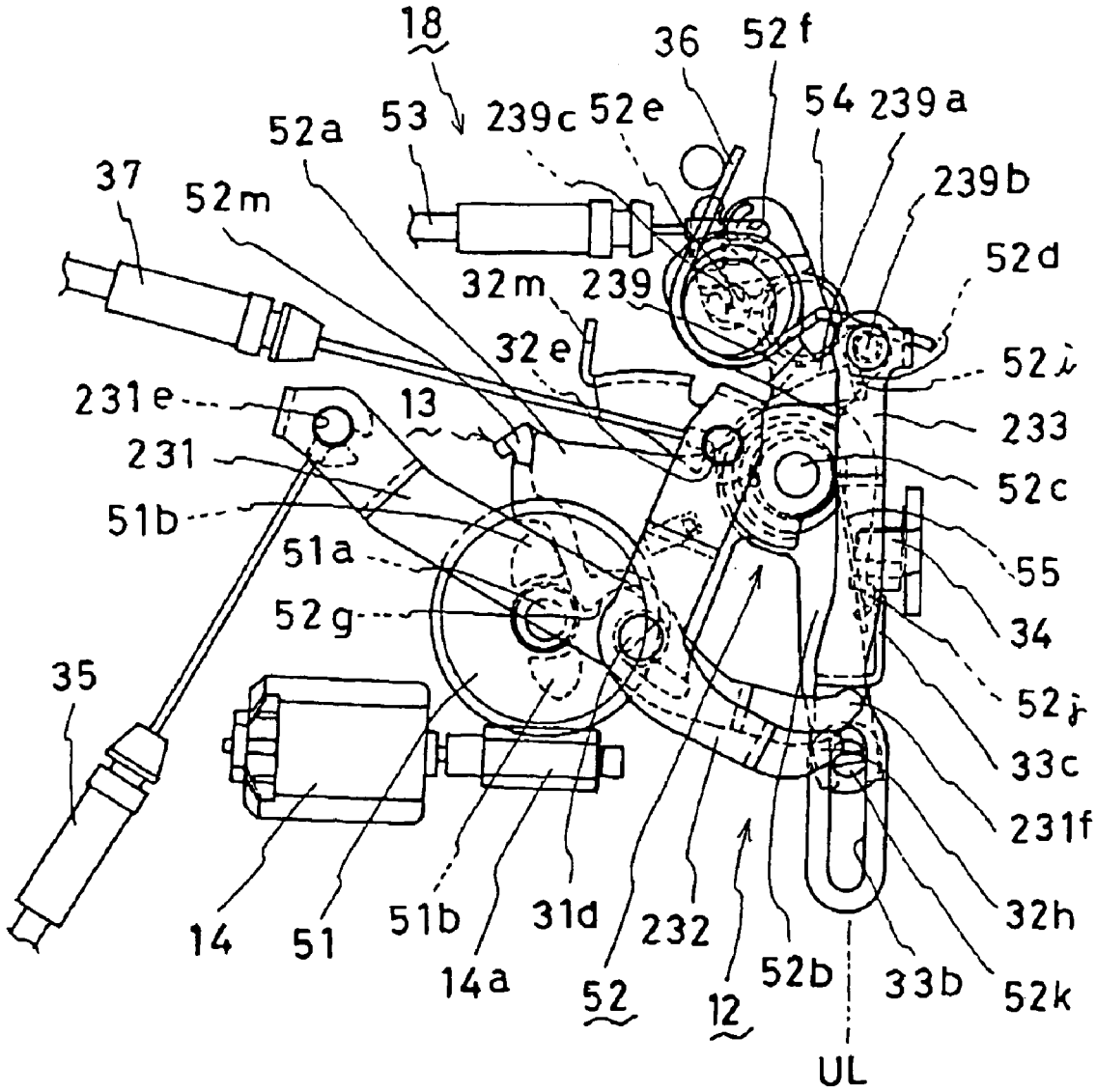
FIG. 19 is a view showing an unlocked state of a door lock device according to a third embodiment of the present invention.

As shown in FIG. 19, the outside open lever 231 is rotatably supported about the pin 31*d* serving as a first rotational axis relative to the cover 41 (shown in FIG. 3). In other words, the outside open lever 231 rotates about the pin 31*d* serving as the rotational axis arranged approximately in parallel with the vertical direction of FIG. 19 corresponding to the thickness direction of the door 70. A connection bore 231*e* is provided at a first end of the outside open lever 231 and an engagement end portion 231*f* is provided at a second end of the outside open lever 231. The connection bore 231*e* is connected to the cable 35 linked to the outside handle 72. By the operational force from the outside handle 72, the outside open lever 231 rotates in the counterclockwise direction of FIG. 19 about the pin 31*d*.

The inside open lever 232 is rotatably supported about the pin 31*d* corresponding to the rotational axis of the outside open lever 231. The inside open lever 232 includes the connection bore 32*e* at a first end thereof and the engagement end portion 32*h* at a second end thereof. The inside open lever 232 includes the cancel flange 32*m* arranged at the left side of the connection bore 32*e* in FIG. 19. The connection bore 32*e* is connected with the cable 37 linked with the inside handle. By the operational force from the inside handle, the inside lever 232 rotates in the counterclockwise direction shown in FIG. 19 about the pin 31*d*.

With the construction of the third embodiment, because the outside open lever 231 and the inside open lever 232 share the rotational axis corresponding to the pin 31*d*, the number of the parts is reduced compared with the construction including pins for respective rotational axis. Further, because the outside open lever 231 and the inside open lever 232 are provided in parallel in the axial direction (i.e., vertical direction of FIG. 19) (i.e., door thickness direction of the door 70), the size of the door lock device 10 in the plane surface direction (i.e., the height direction and the widths direction of the door 70) of the rotational operation of the outside open lever 231 and the inside open lever 232 can be reduced. Particularly, with the construction of the third embodiment, because the outside open lever 231 is provided at further bottom portion of the door lock device 10, the construction of the top portion is simplified.

An arm portion 239*a* of a sub lever 239 is connected to a first end (i.e., top end shown in FIG. 19) of the open link 233 via a pin 239*b*. The sub lever 239 is rotatably supported about a pin 239*c* relative to the cover 41. In case the open link 233 moves approximately upward and downward of FIG. 19, the sub lever 239 rotates about the pin 239*c*.

The operation of the door lock device 10 of the third embodiment will be explained with reference to FIGS. 19–27.

Figure 20:
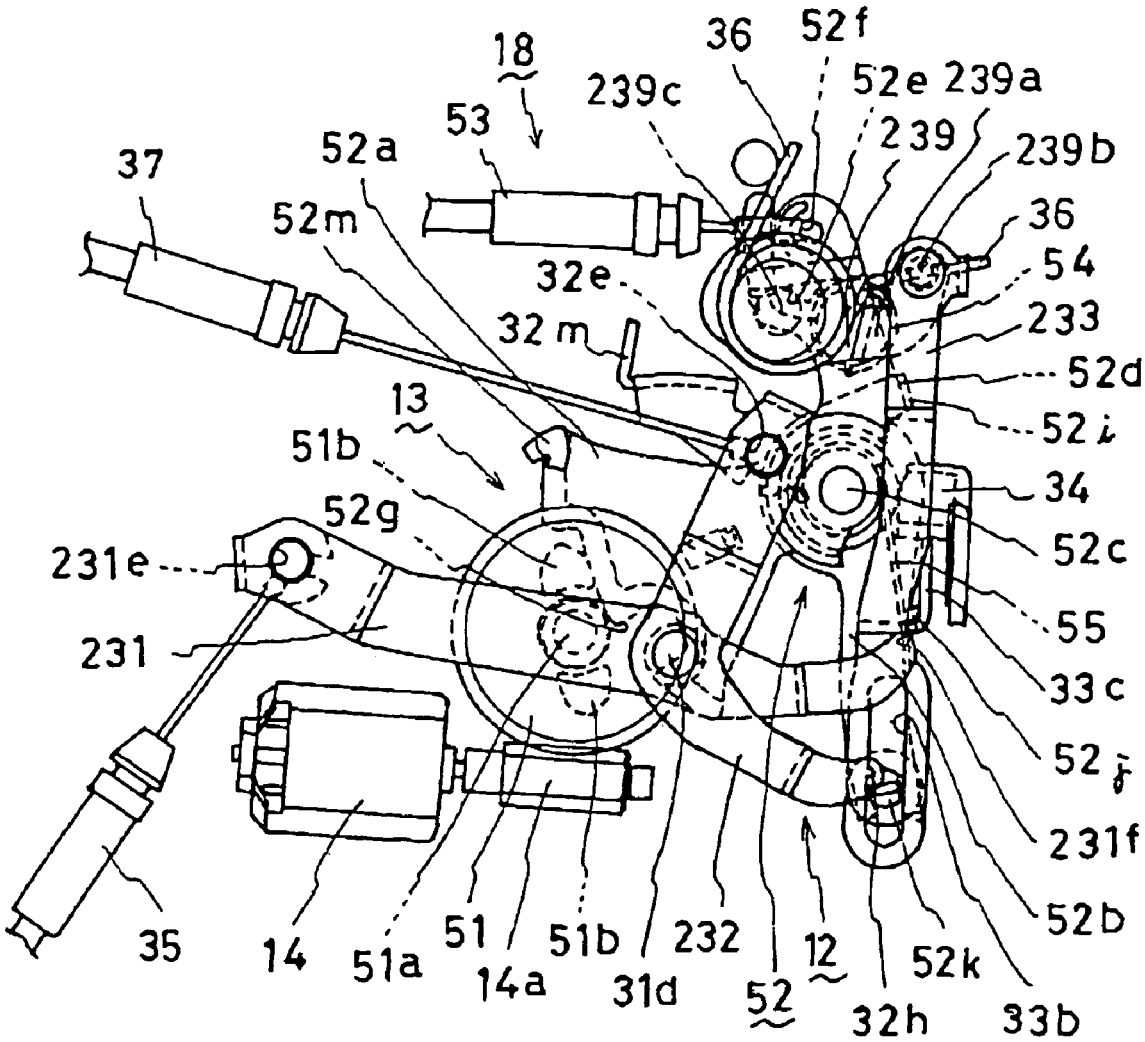
FIG. 20 is a view showing a state at the outside opening operation of the door lock device shown in FIG. 19.

The opening operation at the unlocked state will be explained as follows. FIG. 19 shows the unlocked state where the entire active lever 52 and the open link 233 are at the unlocked position (UL). By the rotation of the outside open lever 231 is the counterclockwise direction about the pin 31*d* in accordance with the operation of the outside handle 72, the engagement end portion 231*f* of the outside open lever 231 is engaged with the flange 33*c*. Thereafter, the open link 233 moves approximately upward of FIG. 19. Further, the flange 33*c* of the open link 233 is engaged with the lift lever 34 to move the lift lever 34 upward of FIG. 19. Thus, the latch mechanism 11 is operated from the latched state to the unlatched state. The state after the foregoing operation is shown in FIG. 20.

Figure 21:
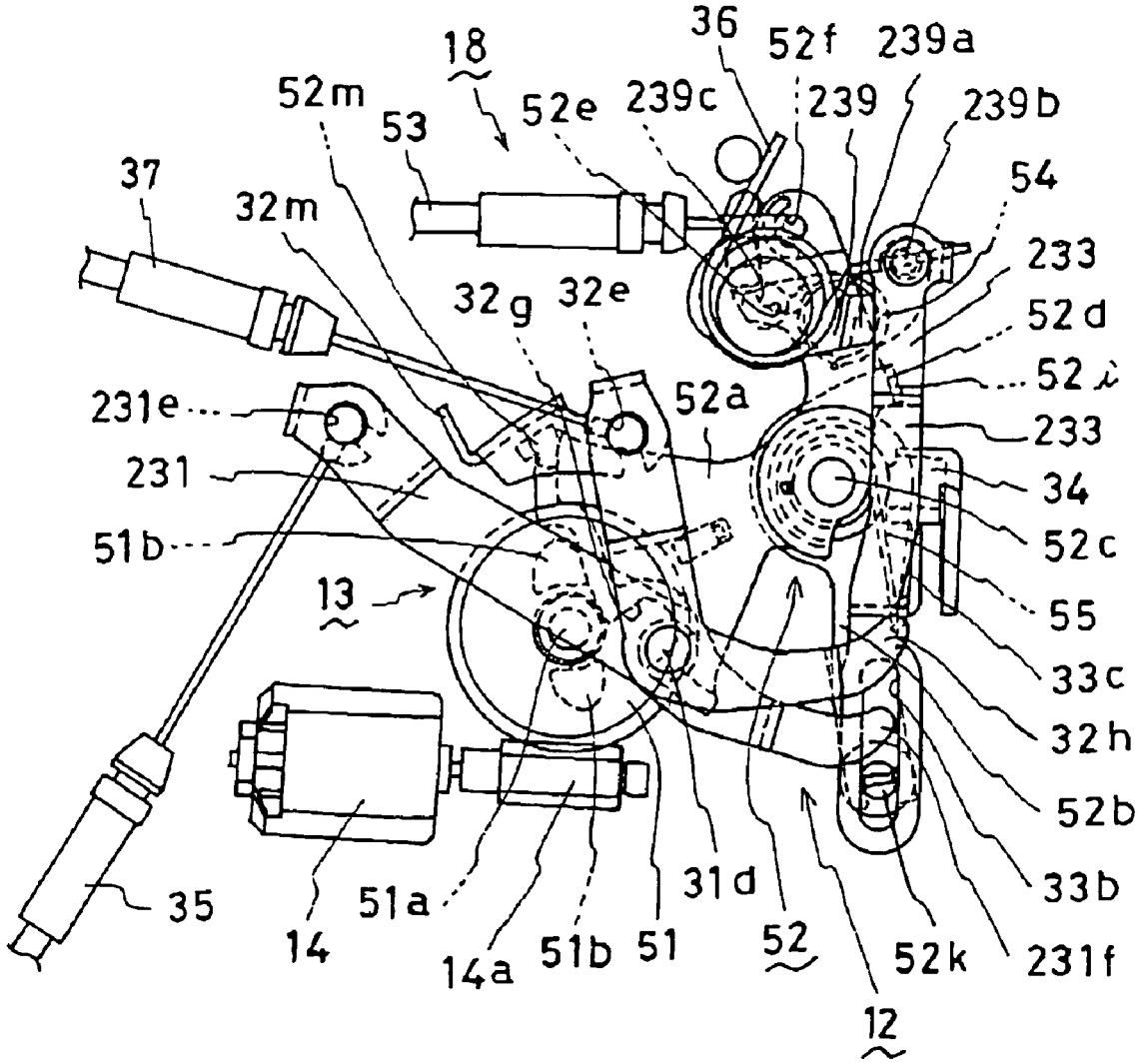
FIG. 21 is a view showing a state at the inside opening operation of the door lock device shown in FIG. 19.

At the unlocked state shown in FIG. 19, in case the inside open lever 232 rotates in the counterclockwise direction about the pin 31*d* in accordance with the operation of the inside handle, the engagement end portion 32*h* of the inside open lever 232 is engaged with the flange 33*c*. Accordingly, the open link 233 moves approximately upward of FIG. 19. The flange 33*c* of the open link 233 is engaged with the lift lever 34 to move the lift lever 34 approximately upward of FIG. 19. Thus, the latch mechanism 11 is operated from the latched state to the unlatched state. The state after the foregoing operation is shown in FIG. 21.

The locking and the unlocking operation of the third embodiment will be explained as follows. For example, in case the motor 14 is actuated, likewise the operation of the first embodiment, the entire active lever 52 rotates. Thus, the open link 233 moves due to the connection construction between the boss 52*k* of the metal lever 52*b* and the connection long bore 33*b* of the open link 233. In other words, the open link 233 rotates by a predetermined angle in the clockwise direction from the unlocked state about the pin 239*b* connected to the sub lever 239. The state after the foregoing operation corresponding to the locked state of the door lock device 10 where the active lever 52 and the open link 233 are positioned at the locked position (L) (shown in FIG. 22). The locking operation may be operated by the rotational operation of the entire active lever 52 about the rotational axis 52*c* via the cable 53 based on the operation of the lock knob.

Figure 22:
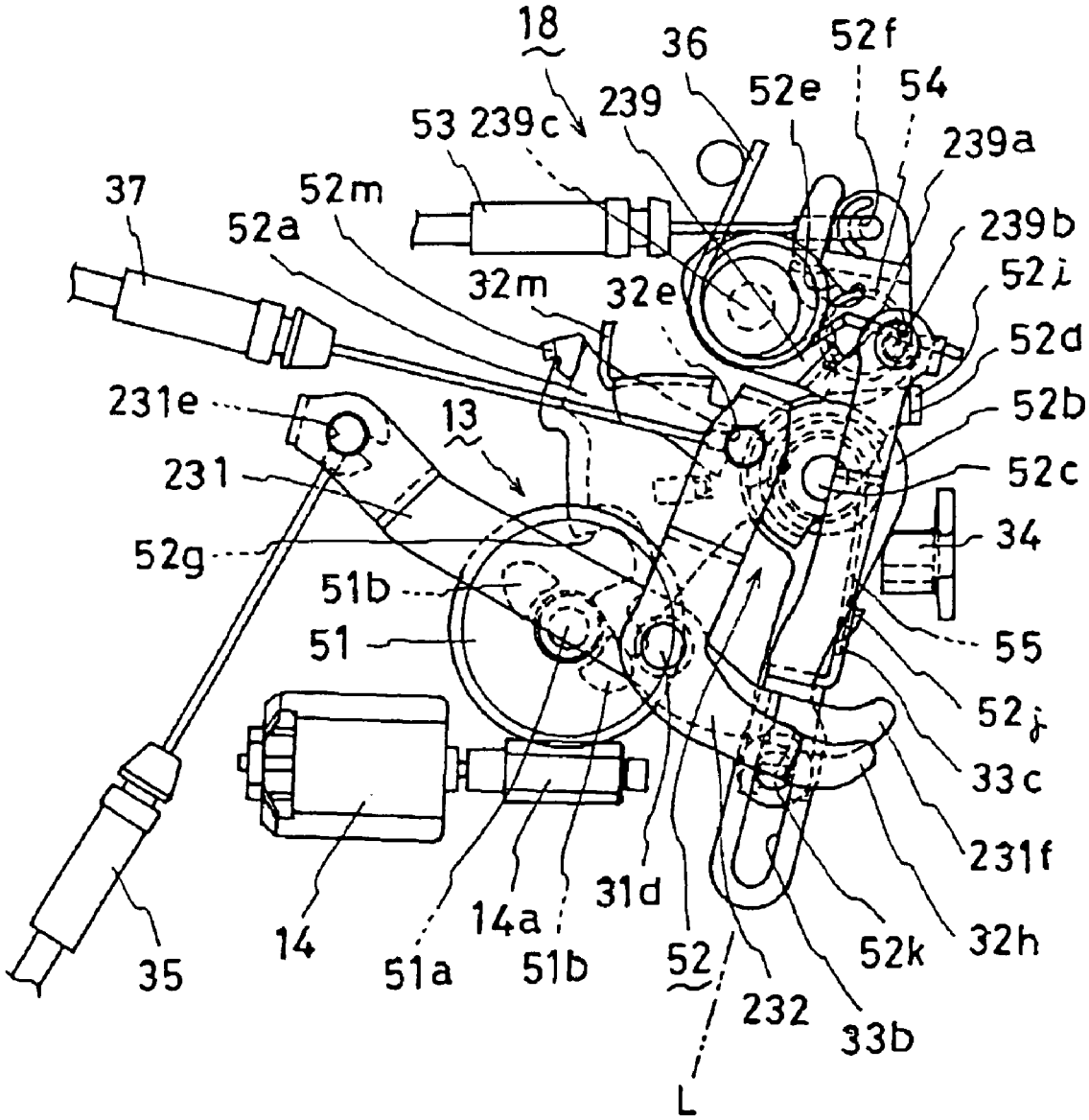
FIG. 22 is a view at a state switched to a locked state of the door lock device shown in FIG. 19.

When the wheel gear 51 rotates in the clockwise direction at the locked state shown in FIG. 22 by the actuation of the motor 14, likewise the first embodiment, the entire active lever 52 rotates. Thereafter, due to the connection between the boss 52*k* of the metal lever 52*b* and the connection long bore 33*b* of the open link 233, the open link 233 rotates to assume the unlocked state shown in FIG. 19.

Figure 23:
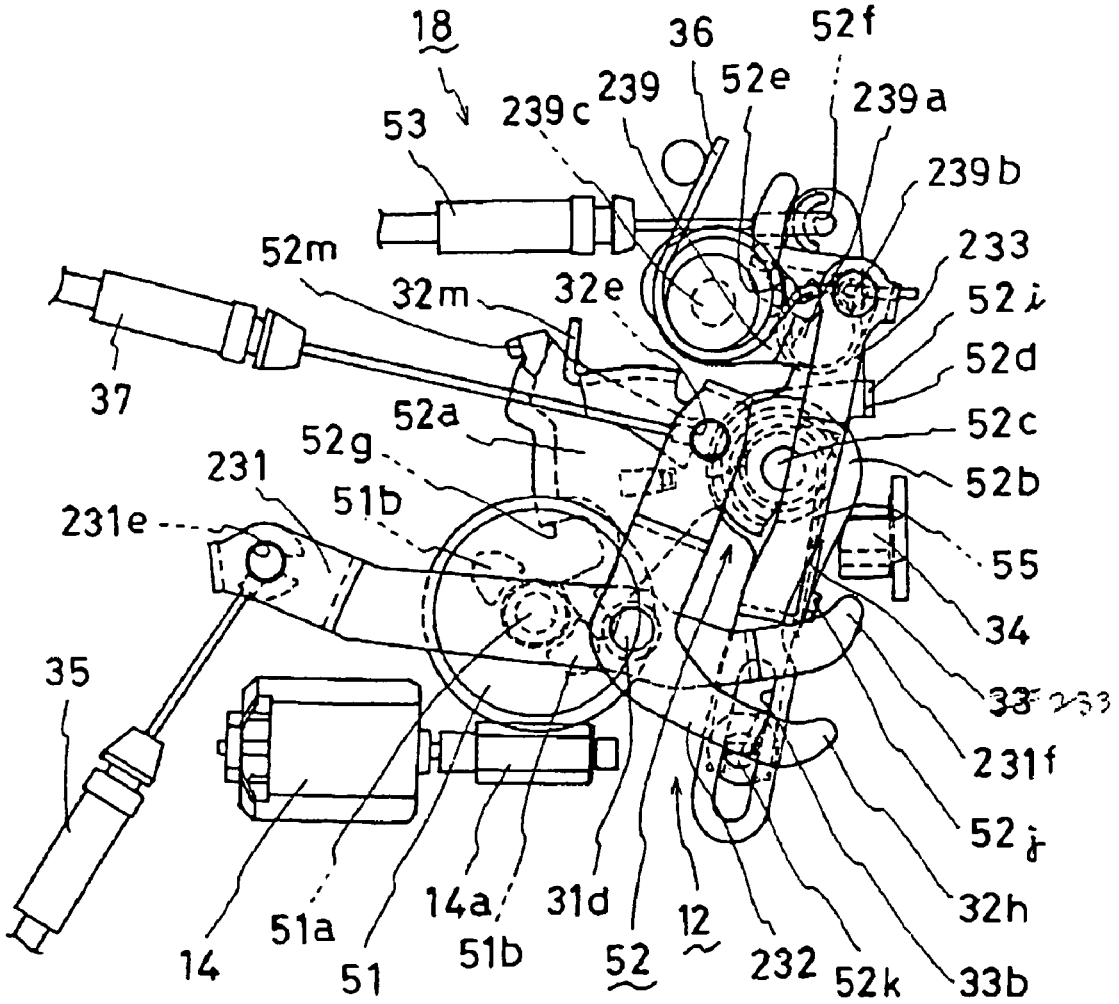
FIG. 23 is a view showing a state at an outside opening operation of the door lock device shown in FIG. 22.

The outside opening operation at the locked state of the third embodiment will be explained as follows. When the outside handle 72 is operated at the locked state shown in FIG. 22, the door lock device operates as follows. In case the outside open lever 231 rotates in the counterclockwise direction, the open link 233 moves approximately upward of FIG. 22. However, the moving locus of the flange 33*c* in accordance with the movement of the open link 233 is off from the lift lever 34. In other words, the flange 33*c* does not contact the lift lever 34. Accordingly, even if the outside open lever 231 rotates, the latch mechanism 11 is not operated from the latched state to the unlatched state. The state after the foregoing operation is shown in FIG. 23. When the outside handle 27 returns from the state shown in FIG. 23, the open link 233 returns to the state shown in FIG. 22 by the biasing force of the spring 36.

The inside opening operation at the locked state of the third embodiment will be explained as follows. When the inside handle is operated at the locked state shown in FIG. 22, the door lock device 10 operates in the following manner. When the inside open lever 232 rotates in the counterclockwise direction of FIG. 22, the cancel flange

32*m* of the inside open lever 232 is engaged with the engagement portion 52*m* of the resin lever 52*a* of the active lever 52 to push the engagement portion 52*m* in the approximately bottom left direction. The state after the foregoing operation is shown in FIG. 24.

Figure 24:
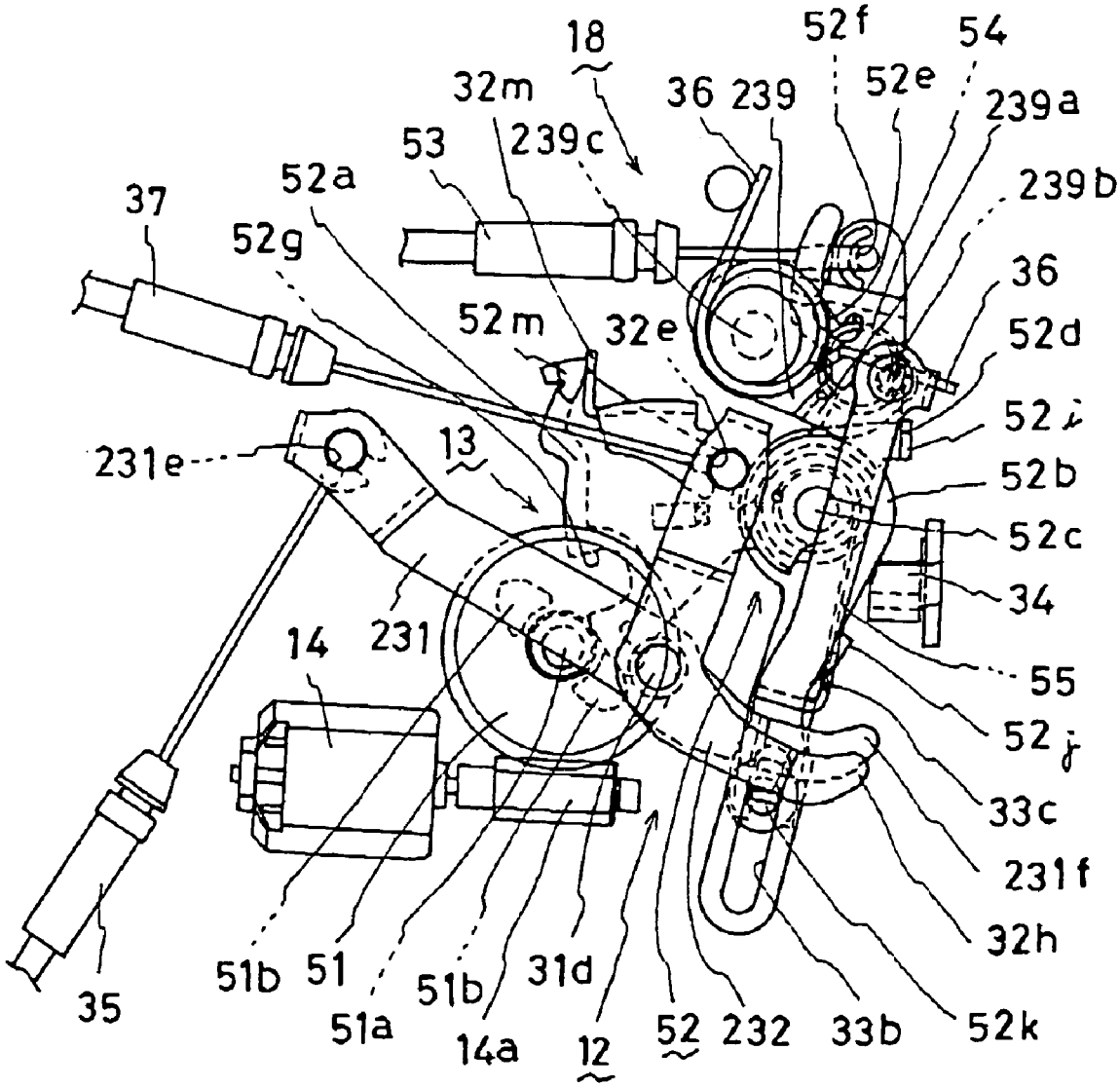
FIG. 24 is a view showing a state at an inside opening operation of the door lock device shown in FIG. 22.

When the inside open lever 232 further rotates in the counterclockwise direction from the state shown in FIG. 24, the resin lever 52*a* engages with the inside open lever 232 to operate together. Thus, the entire active lever 52 rotates in the counterclockwise direction about the rotational axis 52*c*. Accordingly, the entire active lever 52 and the open link 233 move to the unlocked state. The state after the foregoing operation is shown in FIG. 25.

Figure 25:
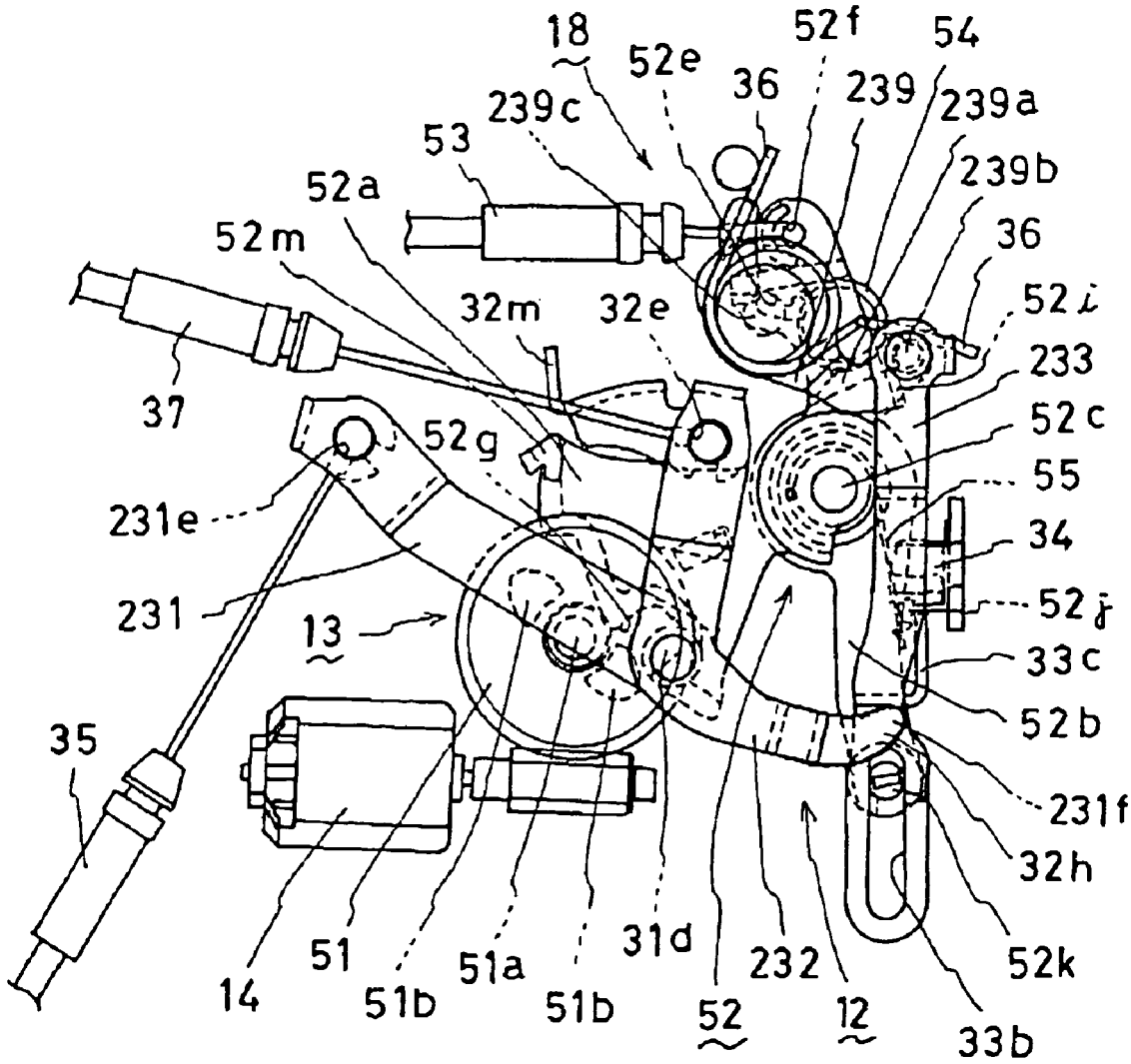
FIG. 25 is a view showing a state at further inside opening operation of the door lock device shown in FIG. 24.

As shown in FIG. 25, the engagement end portion 32*h* of the inside open lever 232 is selectively engaged with the flange 33*c* to move in the approximately upward direction relative to the flange 33*c*. Accordingly, in case the inside open lever 232 further rotates in the counterclockwise direction about the pin 31*d*, likewise the opening operation, the open link 33 moves approximately upward direction of FIG. 25. Because the flange 33*c* is selectively engaged with the lift lever 34 to move in the upward direction, the latch mechanism 11 operates from the latched state to the unlatched state.

As foregoing, the door lock device of the third embodiment includes the one motion function for establishing the switching operation to the unlocked state and the opening operation only by operating the inside handle one time even at the locked state.

The unlocking operation after the opening operation at the locked state of the third embodiment will be explained as follows. The operation when the switching operation from the locked state, shown in FIG. 22, to the unlocked state by the operation of the outside handle 72 and the motor 14 are overlapped or consecutively operated will be explained as follows.

When the outside handle 72 is operated from the state shown in FIG. 22, likewise the foregoing, the state assumes as shown in FIG. 23. By further rotation of the wheel gear 51 in the clockwise direction by the actuation of the motor 14, likewise the foregoing, the entire active lever 52 and the open link 33 are engaged to move to the unlocked position direction. The flange 33*c* of the open link 33 is engaged with the lift lever 34 positioned at the right direction. The state after the foregoing operation is shown in FIG. 26.

Figure 26:
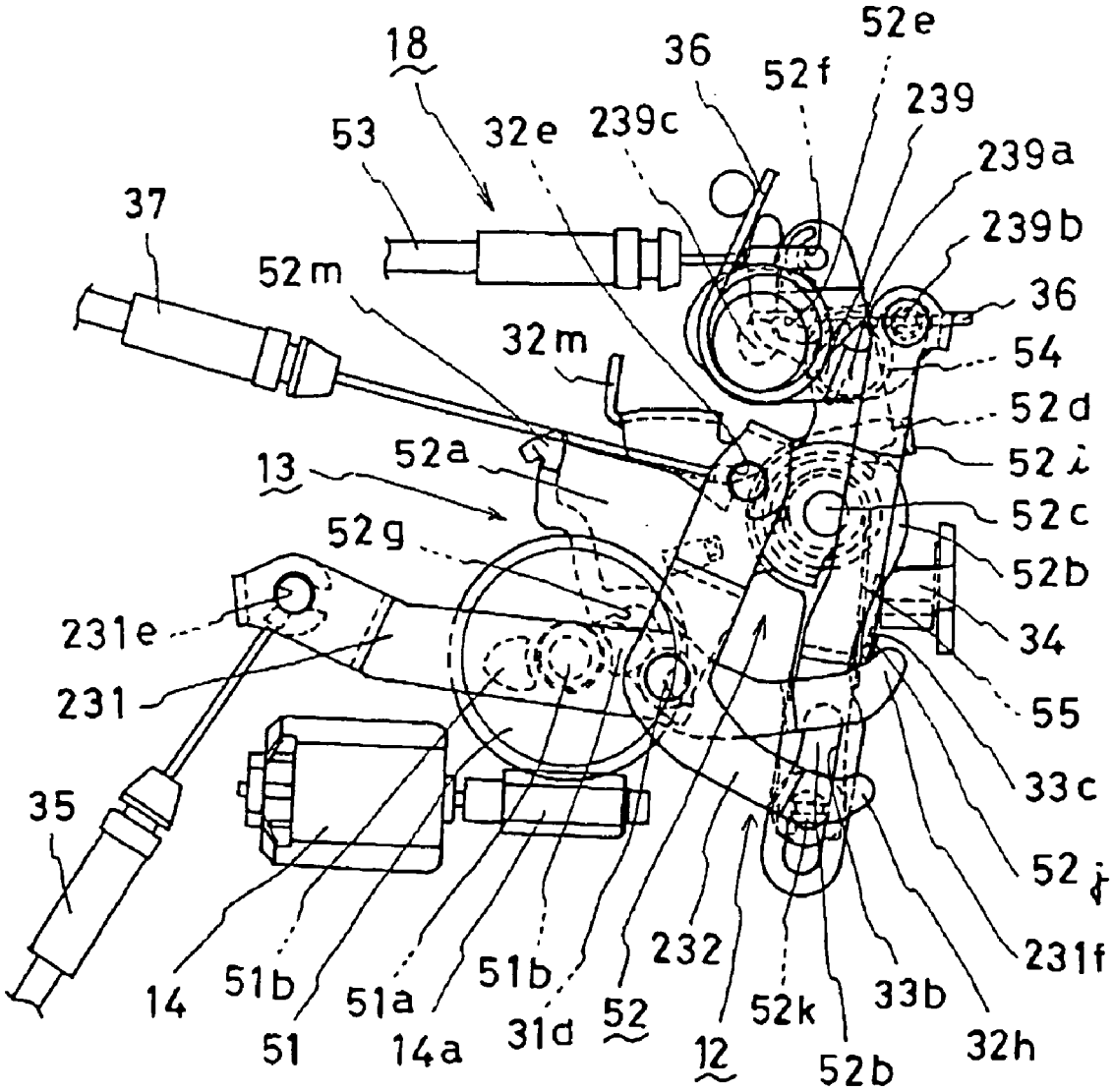
FIG. 26 is a view showing a state switching to the unlocked state of the door lock device shown in FIG. 23.

At the state shown in FIG. 26, although the open link 233 is likely moved in the right direction corresponding to the unlock position, the movement of the open link 233 is restricted by the engagement between the flange 33*c* and the lift lever 34. Likewise the first embodiment, although the resin lever 52*a* keeps rotating in the counterclockwise direction about the rotational axis 52*c* against the biasing force of the spring 55 in accordance with the further rotation of the wheel gear 51, the operation of the open link 233 and the metal lever 52*b* connected to the open link 233 is restricted by the lift lever 34. The state after the foregoing operation is shown in FIG. 27.

Figure 27:
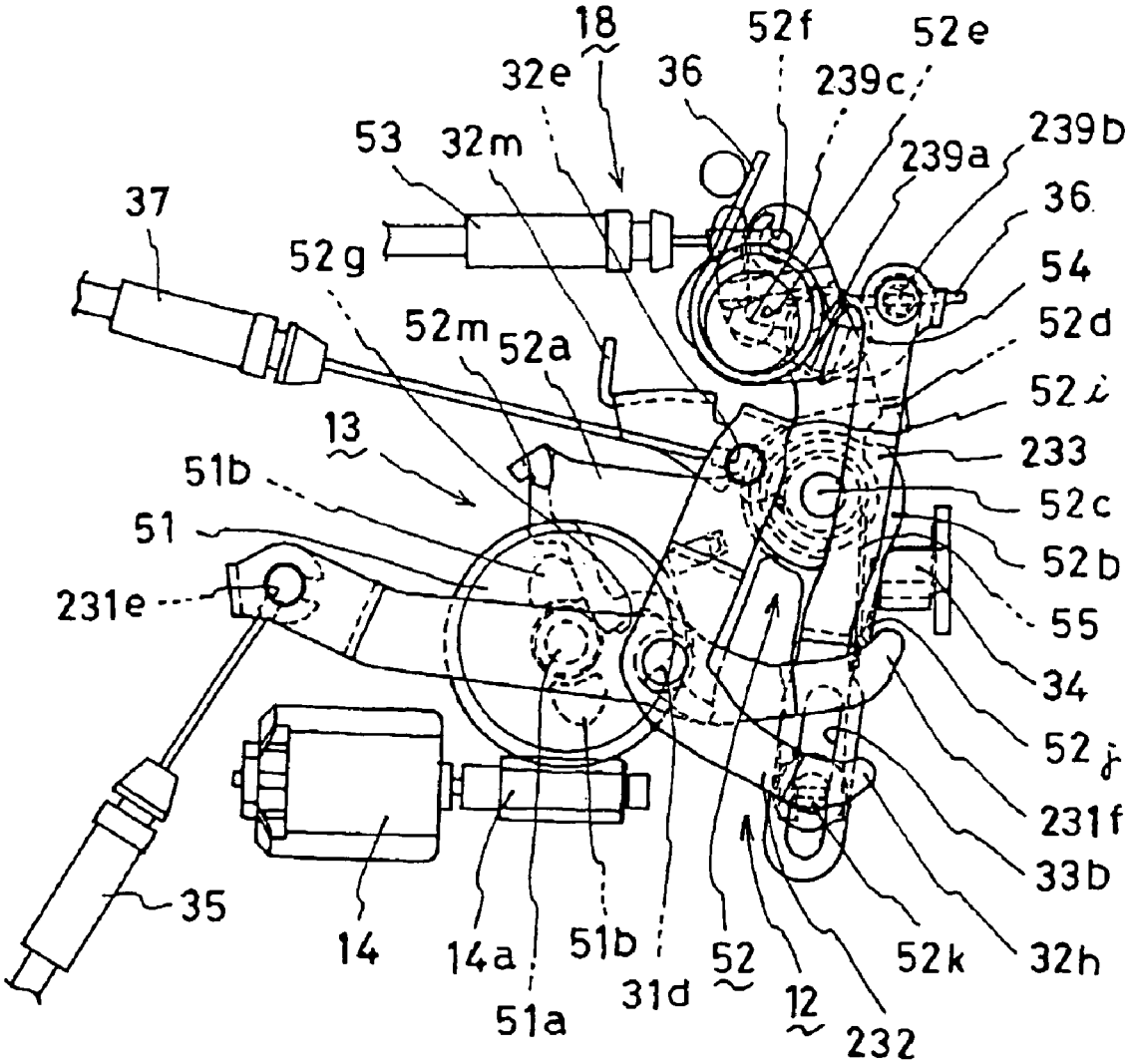
FIG. 27 is a view showing a state switched to further unlocked state of the door lock device shown in FIG. 26.

When the operation of the outside handle 72 returns from the state shown in FIG. 27, the open link 233 moves approximately downward of FIG. 27. When the flange 33*c* and the lift lever 34 are disengaged from each other, the metal lever 52*b* and the open link 233 move to the unlocked position by the biasing force of the spring 55. Accordingly, the unlocked state shown in FIG. 19 is achieved.

As foregoing, with the third embodiment, likewise the first embodiment, the door lock device assumes the unlocked state by returning the operation of the outside handle 72 even if the switching operation to the unlocked state and the opening operation by the outside handle 72 are overlapped or consecutively performed at the locked state. Thus, the unlatched state can be achieved by operating the outside handle 72 next time without the switching operation to the unlocked state second time. This achieves the high operativity.

Figure 28:
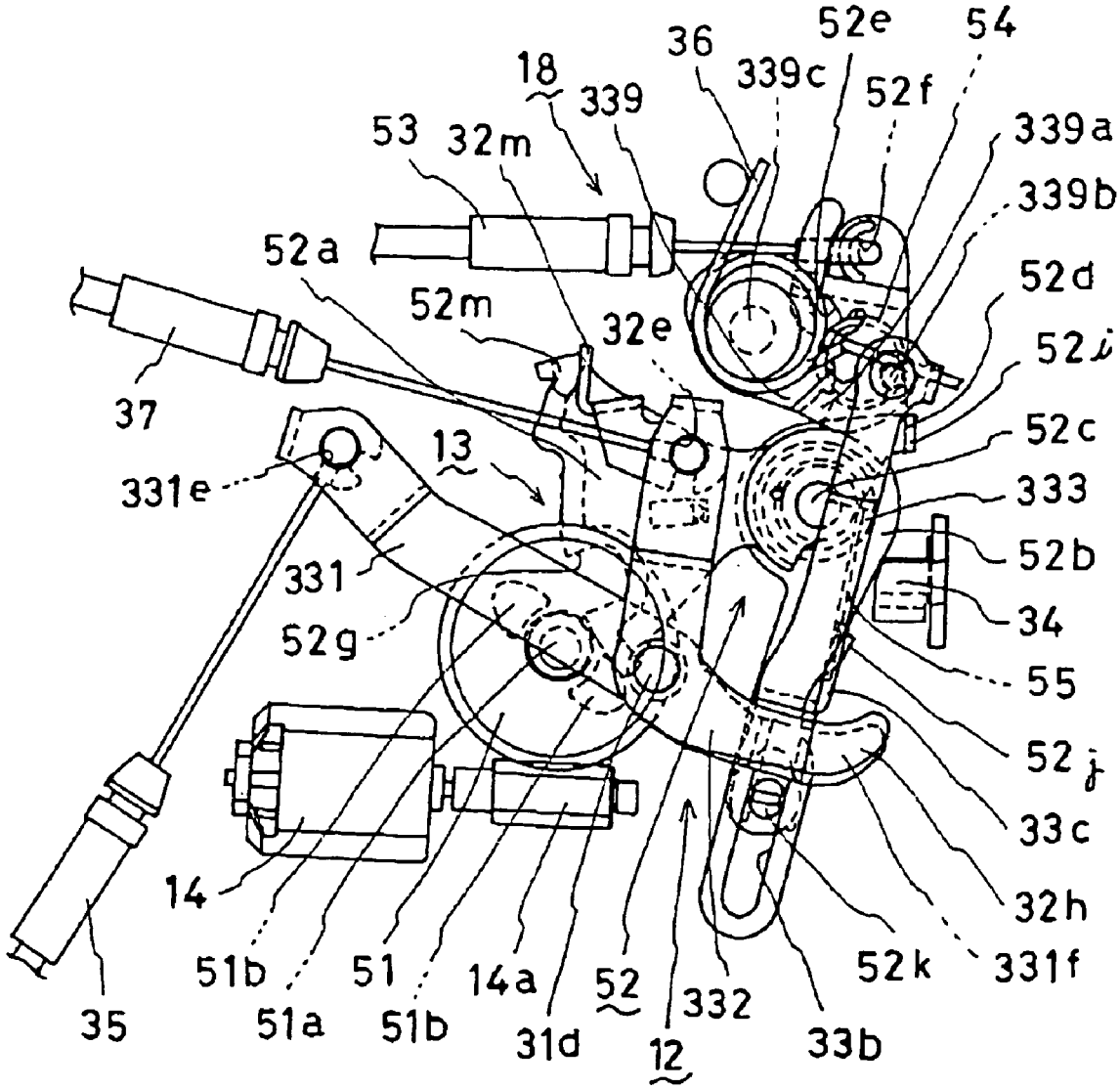
FIG. 28 is a view showing a state at an inside opening operation at a locked state of a door lock device according to a fourth embodiment of the present invention.

A fourth embodiment of the present invention will be explained as follows with reference to FIGS. 28–29. With the fourth embodiment of the present invention, the configuration of an inside open lever 332 is different from the inside open lever 232 of the third embodiment. A distance from the connection bore 32*e* of the inside open lever 332 to the cancel flange 32*m* is shorter than the connection bore 32*e* of the inside open lever 232 to the cancel flange 32*m* of the third embodiment.

The inside opening operation at the locked state will be explained as follows. With the construction of the fourth embodiment, when the inside handle is operated from the locked state corresponding to FIG. 22, the door lock device operates as follows. When the entire inside open lever 332 rotates in the counterclockwise direction, the cancel flange 32*m* of the inside open lever 332 is engaged with the engagement portion 52*m* of the resin lever 52*a* of the active lever 52 to push the engagement portion 52*m* in the approximately bottom left direction. The state after the foregoing operation is shown in FIG. 28.

In accordance with the further operation of the entire inside open lever 332, the inside open lever 332 is engaged with the flange 33*c* of an open link 333 to push the flange 33*c* approximately upward to move the open link 333 in the approximately upward direction. In this case, because the distance from the connection bore 32*e* to the cancel flange 32*m* is shorter with the fourth embodiment, the moving timing of the open link 333 to the unlocked position direction is delayed compared to the timing of the open link 233 to the unlocked position direction of the third embodiment. The flange 33*c* of the open link 333 is engaged with the lift lever 34 provided at the approximately right position. However, the movement of the open link 333 in the approximately right direction is restricted by the engagement with the lift lever 34. With this engagement, likewise the unlocking operation after the opening operation at the locked state of the third embodiment, the portion of the resin lever 52*a* of the active lever 52 rotates in the counterclockwise direction about the rotational axis 52*c* against the biasing force of the spring 55. The state after the foregoing operation is shown in FIG. 29.

Figure 29:
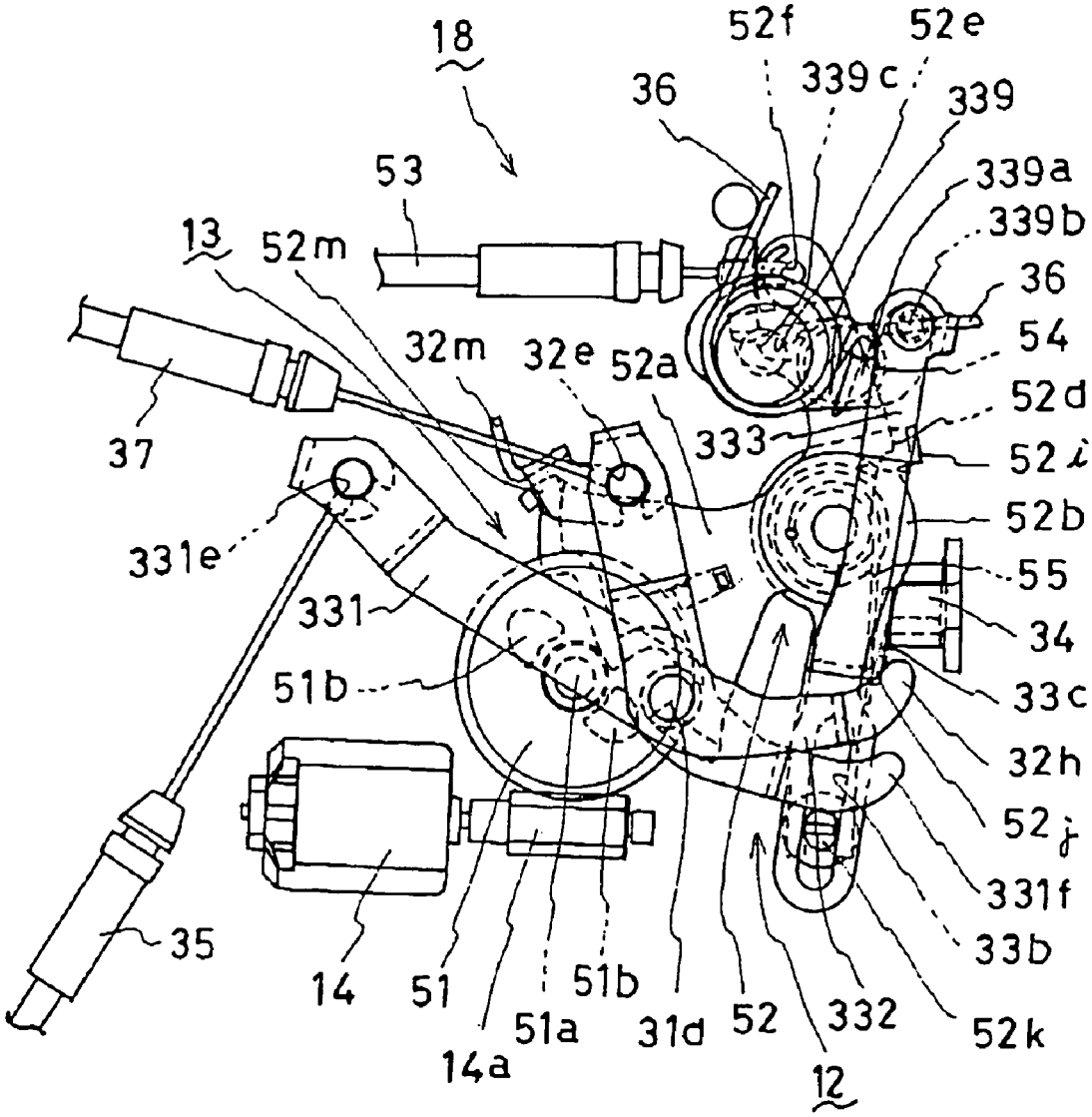
FIG. 29 is a view showing a state at further inside opening operation of the door lock device shown in FIG. 28.

When the operation of the inside handle returns from the state shown in FIG. 29, the open link 333 moves approximately downward of FIG. 29. Thereafter, when the flange 33*c* is disengaged from the lift lever 34, the metal lever 52*b* and the open link 333 move to the unlocked position direction by the biasing force of the spring 55 to achieve the unlocked state corresponding to the state shown in FIG. 19. By operating the inside handle the second time, the normal opening operation is achieved to operate the latch mechanism 11 from the latched state to the unlatched state.

Likewise the second embodiment, the fourth embodiment of the present invention includes the two motion function for establishing the switching operation to the unlocked state and the opening operation by operating the inside handle twice even at the locked state. In other words, the door lock device 10 switches the one motion function and the two-motion function only by slightly changing the configuration of the inside open lever 332.

Although the case half body 44 and the housing half body 40 share the reference wall 40*c* with the construction of the embodiments, with the door lock device of the present invention, the case half body 44 and the housing half body 40 may include walls respectively.

The door lock device 10 may include a lever, or the like, for switching the locked state and the unlocked state by the key operation.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door lock device comprising:

a latch mechanism for being selectively engaged with a striker;

an open unit operating at a plane surface of a housing of the door lock device perpendicular to one direction for transmitting an opening operational force from a vehicle inside and from a vehicle outside to operate the latch mechanism from an engaged state with the striker to the disengaged state from the striker;

a lock unit operating at a plane surface perpendicular to said one direction for transmitting an operational force to the open unit for operating the open unit to be an unlocked state for transmitting the opening operational force to the latch mechanism and a locked state not for transmitting the opening operational force to the latch mechanism;

said one direction being a direction of thickness of a door of a vehicle; and the open unit being positioned at an interior side compared to the lock unit in the direction of thickness of the door.

2. The door lock device according to claim 1, wherein the open unit includes a first lever rotatable about a first rotational axis by the operational force from the vehicle outside, the first rotational axis being arranged approximately in parallel with the direction of thickness of the door.

3. The door lock device according to claim 2, wherein the open unit includes a second lever rotatable about a second rotational axis by the operational force from the vehicle inside, the second rotational axis being arranged approximately in parallel with the direction of thickness of the door and being different from the first rotational axis.

4. The door lock device according to claim 2, wherein the open unit includes a second lever rotatable about the first rotational axis by the operational force from the vehicle inside.

5. The door lock device according to claim 2, wherein the first lever is an outside open lever rotatable about a first pin.

6. The door lock device according to claim 3, wherein the second lever is an inside open lever rotatable about a second pin.

7. A door lock device comprising:

a latch mechanism for being selectively engaged with a striker;

an open unit operating at a plane surface of a housing of the door lock device perpendicular to one direction for transmitting an opening operational force from a vehicle inside and from a vehicle outside to operate the latch mechanism from an engaged state with the striker to the disengaged state from the striker;

a lock unit operating at a plane surface perpendicular to said one direction for transmitting an operational force to the open unit for operating the open unit to be an unlocked state for transmitting the opening operational force to the latch mechanism and a locked state not for transmitting the opening operational force to the latch mechanism;

said one direction being a direction of thickness of a door of a vehicle; and the open unit including a first lever rotatable about a first rotational axis by the operational force from the vehicle outside, the first rotational axis being arranged approximately in parallel with the direction of thickness of the door.

8. The door lock device according to claim 7, wherein the open unit includes a second lever rotatable about a second rotational axis by the operational force from the vehicle inside, the second rotational axis being arranged approximately in parallel with the direction of thickness of the door and being different from the first rotational axis.

9. The door lock device according to claim 7, wherein the open unit includes a second lever rotatable about the first rotational axis by the operational force from the vehicle inside.

10. The door lock device according to claim 7, wherein the first lever is an outside open lever rotatable about a pin.

11. The door lock device according to claim 8, wherein the second lever is an inside open lever rotatable about a pin.

* * * * *